US007771266B2

(12) United States Patent
Gerrard et al.

(10) Patent No.: US 7,771,266 B2
(45) Date of Patent: Aug. 10, 2010

(54) GAMING DEVICE HAVING A MULTIPLE ACCUMULATED SYMBOLS GAME

(75) Inventors: Peter Gerrard, Prestwich (GB); Dov L. Randall, Whitefield (GB); Michael Evans, Goostrey (GB)

(73) Assignee: IGT, Reno, NV (US)

( * ) Notice: Subject to any disclaimer, the term of this patent is extended or adjusted under 35 U.S.C. 154(b) by 1001 days.

(21) Appl. No.: 10/660,810

(22) Filed: Sep. 11, 2003

(65) Prior Publication Data

US 2005/0059455 A1 Mar. 17, 2005

(51) Int. Cl.
*A63F 9/24* (2006.01)

(52) U.S. Cl. ..... 463/20

(58) Field of Classification Search ..... 463/10, 463/16, 20, 21, 22, 25, 26, 30, 28
See application file for complete search history.

(56) References Cited

U.S. PATENT DOCUMENTS

| | | | |
|---|---|---|---|
| 4,182,515 | A | 1/1980 | Nemeth |
| 4,363,489 | A | 12/1982 | Chodak et al. |
| 4,560,161 | A | 12/1985 | Hamano |
| 4,582,324 | A | 4/1986 | Koza et al. |
| 4,624,459 | A | 11/1986 | Kaufman |
| 5,046,737 | A | 9/1991 | Fienberg |
| 5,205,555 | A | 4/1993 | Hamano |
| 5,342,047 | A | 8/1994 | Heidel et al. |
| 5,380,007 | A | 1/1995 | Travis et al. |
| 5,536,016 | A | 7/1996 | Thompson |
| 5,647,798 | A | 7/1997 | Falciglia |
| 5,743,524 | A | 4/1998 | Nannicola |
| 5,823,873 | A | 10/1998 | Moody |
| 5,833,536 | A | 11/1998 | Davids et al. |
| 5,855,514 | A | 1/1999 | Kamille |

(Continued)

FOREIGN PATENT DOCUMENTS

| | | |
|---|---|---|
| GB | 2226436 | 6/1990 |

(Continued)

OTHER PUBLICATIONS

Sumo_Gamer. Top 10 Lists : The Top 10 Most Frustrating MiniGames Ever Devised <URL: http://www.gamefaqs.com/features/top10/1041.htm I>.*

(Continued)

*Primary Examiner*—Peter DungBa Vo
*Assistant Examiner*—Omkar Deodhar
(74) *Attorney, Agent, or Firm*—K&L Gates LLP

(57) ABSTRACT

A gaming device including a display device having a plurality of award groups and an indicator generator. Each of the award groups includes at least one indicator and at least one award. The indicator generator generates a number of indicators for each of the award groups. The gaming device then indicates the corresponding number of indicators in each of the award columns based on the number of indicators associated with those award columns by the indicator generator. When all of the indicators are accumulated in one or more of the award columns, the gaming device provides the awards associated with those award columns to the player and determines whether to end the game. If the gaming device determines not to end the game, the gaming device resets the indicators in the award columns including the provided wards and enables the player to continue playing the game.

56 Claims, 17 Drawing Sheets

U.S. PATENT DOCUMENTS 6,012,982 A 1/2000 Piechowiak et al.
6,015,346 A 1/2000 Bennett
6,059,289 A 5/2000 Vancura
6,089,976 A 7/2000 Schneider et al.
6,102,798 A 8/2000 Bennett
6,149,156 A 11/2000 Feola
6,168,523 B1 1/2001 Piechowiak et al.
6,179,710 B1 1/2001 Sawyer et al.
6,179,711 B1 * 1/2001 Yoseloff ..... 463/25
6,203,429 B1 3/2001 Demar et al.
6,231,442 B1 5/2001 Mayeroff
6,261,177 B1 7/2001 Bennett
6,302,790 B1 10/2001 Brossard
6,309,300 B1 10/2001 Glavich
6,311,976 B1 11/2001 Yoseloff et al.
6,312,334 B1 11/2001 Yoseloff
6,315,660 B1 11/2001 DeMar et al.
6,315,664 B1 11/2001 Baerlocher et al.
6,322,309 B1 11/2001 Thomas et al.
6,328,649 B1 12/2001 Randall et al.
6,346,043 B1 2/2002 Colin et al.
6,347,996 B1 2/2002 Gilmore et al.
6,364,766 B1 * 4/2002 Anderson et al. ..... 463/16
6,364,767 B1 4/2002 Brossard et al.
6,375,569 B1 4/2002 Acres
6,398,218 B1 6/2002 Vancura
6,398,644 B1 6/2002 Perrie et al.
6,406,369 B1 6/2002 Baerlocher et al.
6,425,824 B1 7/2002 Baerlocher et al.
6,439,995 B1 8/2002 Hughs-Baird et al.
6,443,837 B1 9/2002 Jaffe et al.
6,464,582 B1 10/2002 Baerlocher et al.
6,494,785 B1 12/2002 Gerrard et al.
6,506,118 B1 1/2003 Baerlocher et al.
6,514,141 B1 2/2003 Kaminkow et al.
6,572,472 B1 6/2003 Glavich
6,575,830 B2 6/2003 Baerlocher et al.
6,582,306 B1 6/2003 Kaminkow
6,585,591 B1 7/2003 Baerlocher et al.
6,599,185 B1 7/2003 Kaminkow et al.
6,599,193 B2 7/2003 Baerlocher et al.
6,602,135 B1 8/2003 Gerrard
6,602,136 B1 8/2003 Baerlocher et al.
6,602,137 B2 8/2003 Kaminkow et al.
6,607,437 B2 8/2003 Casey et al.
6,607,438 B2 8/2003 Baerlocher et al.
6,609,974 B2 8/2003 Mead et al.
6,632,141 B2 10/2003 Webb et al.
6,634,943 B1 10/2003 Baerlocher
6,659,864 B2 12/2003 McGahn et al.
6,682,419 B2 1/2004 Webb et al.
6,688,975 B2 2/2004 Baerlocher et al.
6,712,694 B1 3/2004 Nordman
6,722,983 B2 4/2004 Kaminkow et al.
6,749,504 B2 6/2004 Hughs-Baird
6,773,345 B2 8/2004 Walker et al.
6,776,711 B1 8/2004 Baerlocher
6,796,899 B2 9/2004 Baerlocher
6,796,900 B2 9/2004 Baerlocher et al.
6,808,452 B2 10/2004 Baerlocher et al.
6,817,944 B2 11/2004 Kaminkow et al.
6,843,721 B2 * 1/2005 Vancura ..... 463/16
6,958,013 B2 10/2005 Miereau et al.
2002/0010018 A1 * 1/2002 Lemay et al. ..... 463/20
2003/0036418 A1 * 2/2003 Seelig et al. ..... 463/16
2004/0048649 A1 3/2004 Peterson et al.
2004/0147306 A1 7/2004 Randall et al.
2004/0185932 A1 * 9/2004 Lombardo ..... 463/21
2005/0033461 A1 2/2005 Gerrard et al.
2005/0054413 A1 3/2005 Randall et al.
2005/0064929 A1 3/2005 Kaminkow et al.
2005/0101372 A1 5/2005 Mierau et al.
2006/0217183 A1 9/2006 Mierau et al.

FOREIGN PATENT DOCUMENTS

GB 2353128 A * 1/2000
GB 2353128 A * 2/2001

OTHER PUBLICATIONS

"Battle Plan" Article written by Strictly Slots, published in Sep. 2000.
Battleship Advertisement, written by Mikohn, published in 2003.
"Believe It or not" Article written by Strictly Slots, published Jun. 2001.
Big Bang Piggy Bank in Advertisement, written by WMS Gaming, Inc, published prior to 2000.
Bingo Advertisement written by Casino Data Systems, published 1998.
Bonus Spin Advertisement written by IGT, published prior to 2000.
By George Advertisement written by IGT, published 2002.
Cash Box Advertisement & Article written by Anchor Games, Strictly Slots, published in Jul. 2000.
Fire and Fortune Article written by Strictly Slots, published in 2001.
Five Card Instant Bingo Advertisement written by IGT, published 2000.
Fox "N" Hound Advertisement written by IGT, published in 2000, on or before December thereof.
Good Times Advertisement written by IGT, published in 1999, on or before December thereof.
Double Jeopardy Advertisement written by IGT, published in 2000.
Jeopardy Advertisement written by IGT, published prior to 2001.
Jeopardy Advertisements, written by IGT, published prior to 2001.
Jumble Advertisement written by Strictly Slots published prior to 2000.
Jumble description, written by WMS Gaming, Inc., printed from www.wmsgaming.com Mar. 2001.
Little Green Men, Jr. Advertisement written by Strictly Slots, published Feb. 2003.
Monopoly Brochures and Articles written by WMS Gaming, Inc, published Jan. 13, 1999.
Monopoly Party Train, written by Strictly Slots, published Feb. 2002.
Munsters Advertisement written by Igt, published in 2001.
Munsters Article written by Strictly Slots, published Apr. 2001.
Neon Nights Advertisement written by IGT, published in 2002.
Price is Right "Showcases" Description written by schuminweb.com (web site), printed Mar. 16, 2001.
Regis Cash Club Advertisement written by IGT, published prior to 2003.
Razzle Advertisement written by Bar Crest, published prior to 2003.
Wheel & Deal Article written by Strictly Slots, published in Dec. 2001.
Wheel of Fortune Slots Advertisement written by IGT, published in 2002.
Winning Bid Advertisement written by WMS Gaming, Inc., published prior to Aug. 20, 2001.
X Factor Advertisement written by WMS Gaming, Inc, dated Jan. 15, 2001.

* cited by examiner

GAMING DEVICE HAVING A MULTIPLE ACCUMULATED SYMBOLS GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming device manufacturers strive to make wagering gaming devices that provide as much enjoyment, entertainment and excitement as possible for players. Providing interesting and exciting primary or base games and secondary or bonus games in which a player has an opportunity to win potentially large awards or credits is one way to enhance player enjoyment and excitement. Another way to enhance a player's enjoyment, entertainment and excitement with a gaming device is by including lights, sounds and other visual or audio or audio-visual effects in the gaming machines.

Certain known gaming devices use mechanical devices such as reels, wheels and light displays to enhance the attraction of the machines to players and also to enhance the player's game playing experience. These mechanical devices enable a player to see physical movements of a game, a portion of a game, or a functional game event or element which increases the player's enjoyment of the game.

To increase player enjoyment and excitement, it is desirable to provide new and different mechanical devices in conjunction with wagering gaming devices.

SUMMARY OF THE INVENTION

The present invention relates generally to a gaming device and, more particularly, to a gaming device including a display device which enables a player to simultaneously accumulate indicators in a plurality of award groups to obtain one or more awards in a game.

In one embodiment, the gaming device includes a secondary display device which displays a plurality of award groups such as award columns to a player. In one embodiment, the gaming device causes an indicator generator to generate, display and associate a number of indicators with each of the award groups or columns. A number of indicators are accumulated in each of the award columns corresponding to the number of indicators generated by the indicator generator for each of the award columns. The gaming device continues to activate the indicator generator until all the indicators of at least one of the award columns are fully indicated or accumulated, or alternatively indicated or accumulated to a designated level. The gaming device then provides the award or awards to the player associated with any fully indicated award columns. Once the awards are provided to the player, the gaming device determines whether to continue the game or end the game. In one embodiment, this determination is random. If the gaming device determines to end the game, the player receives the accumulated awards in the game and the game ends.

Alternatively, if the gaming device determines not to end the game (or to continue the game), the gaming device resets the indicators (i.e., de-activates the indicators or eliminates the accumulated indicators) in the award columns associated with the awards provided to the player (i.e., the awards the player accumulated or won) and causes the indicator generator to generate and associate a number of indicators with the award columns until all of the indicators in one or more of the award columns are subsequently fully indicated. In one embodiment, the gaming device does not reset the indicators of the award columns that do not include one of the provided awards. Therefore, the player has a better opportunity to indicate the remaining indicators in these award columns and accumulate the award or awards associated with those award columns. As described above, the player hopes to accumulate as many awards as possible before the gaming device determines to end the game. Thus, the gaming device enables a player to have an opportunity to accumulate one or more awards in a game and possibly to accumulate a relatively large award in the game which increases the player's excitement and enjoyment of the game.

In one embodiment, a probability of ending or alternatively, continuing a game is associated with a game where the gaming device determines whether to end or continue a game based on the probability. The probability may change one or more times in a game or change in one or more games.

In another embodiment, the gaming device causes the indicator generator to generate, display and associate a number of indicators with each of the award columns. As described above, a number of indicators are accumulated in each of the award columns corresponding to the number of indicators generated by the indicator generator for each of the award columns. The gaming device continues to activate the indicator generator until all the indicators of at least one of the award columns are fully indicated or accumulated. The gaming device then indicates the awards associated with the fully indicated award columns. Once the awards are indicated, the gaming device determines whether to provide the indicated award or awards to the player. In one embodiment, this determination is random. If the gaming device determines that the indicated awards are to be provided to the player, the gaming device provides the indicated awards and any awards previously acquired in a game or games to the player and ends the game.

Alternatively, if the gaming device determines not to provide the indicated award or awards to the player, the gaming device resets the indicators in the award columns associated with the indicated awards (i.e., the awards the player could have won) and causes the indicator generator to generate and associate a number of indicators with the award columns until all of the indicators in one or more of the award columns are fully indicated. The gaming device does not reset the indicators of the award columns that do not include one of the indicated awards. Therefore, the player still has an opportunity to indicate the remaining indicators in these award columns and potentially receive the award or awards associated with those award columns. The gaming device also does not provide any awards previously acquired by the player until all of the indicators in at least one of the award columns are fully indicated. Therefore, in a game, the player hopes to obtain the largest awards associated with the award columns and also several of the awards associated with the award columns.

In one embodiment, a probability of providing the awards to a player are associated with the awards in a game. The gaming device therefore determines whether to provide an indicated award or a plurality of indicated awards to a player in a game based on the probability. For example, when an award or awards are indicated in a game (i.e., all of the indicators in the award columns having those awards are fully indicated or accumulated), the gaming device determines whether to provide the award or awards to the player based on the probability. The probability may be randomly determined, predetermined, determined based on a wager made by the player or determined according to any suitable determination method.

In another embodiment, an independent probability of providing an award to the player is associated with each of the awards of the award columns. In this embodiment, the gaming device determines whether to provide an indicated award to the player based on the independent probability associated with that award. It should be appreciated that at least two of the probabilities, a plurality of the probabilities, or all of the probabilities may be different. In one embodiment, a relatively large award is associated with one of the award columns and a plurality of relatively small awards are associated with the other award columns in the game. In this embodiment, the probability associated with the relatively large award is less than the probabilities associated with the relatively small awards. It should be appreciated that the probability may change in each activation of the reel or in a plurality of activations of the reel in a game.

In one embodiment, the secondary display device is connected to the top of the cabinet of the gaming device and includes a plurality of award groups or award columns and a indicator generator which generates and associates a number of indicators with the award columns. In one embodiment, the award columns are displayed on the display device and include at least one indicator and in one embodiment, a plurality of indicators. Additionally, the award columns include at least one award. In one embodiment, at least two of the award columns include a different number of indicators. In a further embodiment, all of the award columns include different numbers of indicators. It should be appreciated that the award columns may include any suitable number of indicators in a game.

In one embodiment, the indicator generator includes a rotatable display which rotates and indicates a number of indicators for each of the award columns in a game. In one embodiment, the rotatable display includes two rollers and a belt which frictionally engages the rollers. A drive roller which is powered by a suitable motor coupled to the drive roller, rotates the belt in a clockwise, counter-clockwise or any suitable combination of directions. The belt includes sections having at least one number of indicators. The number of indicators may be a negative value, a positive value, a null value or zero value or any suitable value or values. In a game, the processor in the gaming device controls the drive roller and causes the drive roller to rotate to align one of the number of indicators with each of the award columns. It should be appreciated that any suitable indicator generator may be employed in a game such as a reel, a plurality of reels or a mechanical wheel.

In one embodiment, an illumination device is connected to each of the indicators in the award columns. The illumination device illuminates or lights up the indicator when the indicators are indicated in a game. It should be appreciated that one or a plurality of illumination devices may be employed in the game and connected to one or more of the indicators in the award columns. In another embodiment, the illumination devices connected to the indicators in each of the award columns include different color lights. In one aspect of this embodiment, the colors of the lights associated with each of the award columns are different.

In one embodiment, the award associated with each of the award columns is positioned adjacent to the top or highest indicator in each of the award columns. It should be appreciated that the award may be positioned in any suitable location on the display device. It should also be appreciated that the award may include at least one modifier, free game, free spin, free activation, game element or any other suitable award or awards.

In one embodiment, at least two of the awards associated with the award columns are different. In another embodiment, at least two of the awards associated with the award columns are the same. It should be appreciated that any suitable combination of awards may be associated with the award columns in a game.

It is therefore an advantage of the present invention to provide a gaming device that increases the probability of obtaining a plurality of awards in a game.

Another advantage of the present invention is to provide a gaming device that increases the probability of obtaining a relatively large award in a game.

It is a further advantage of the present invention to provide a gaming device that increases the probability of obtaining multiple awards in a game.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1A:
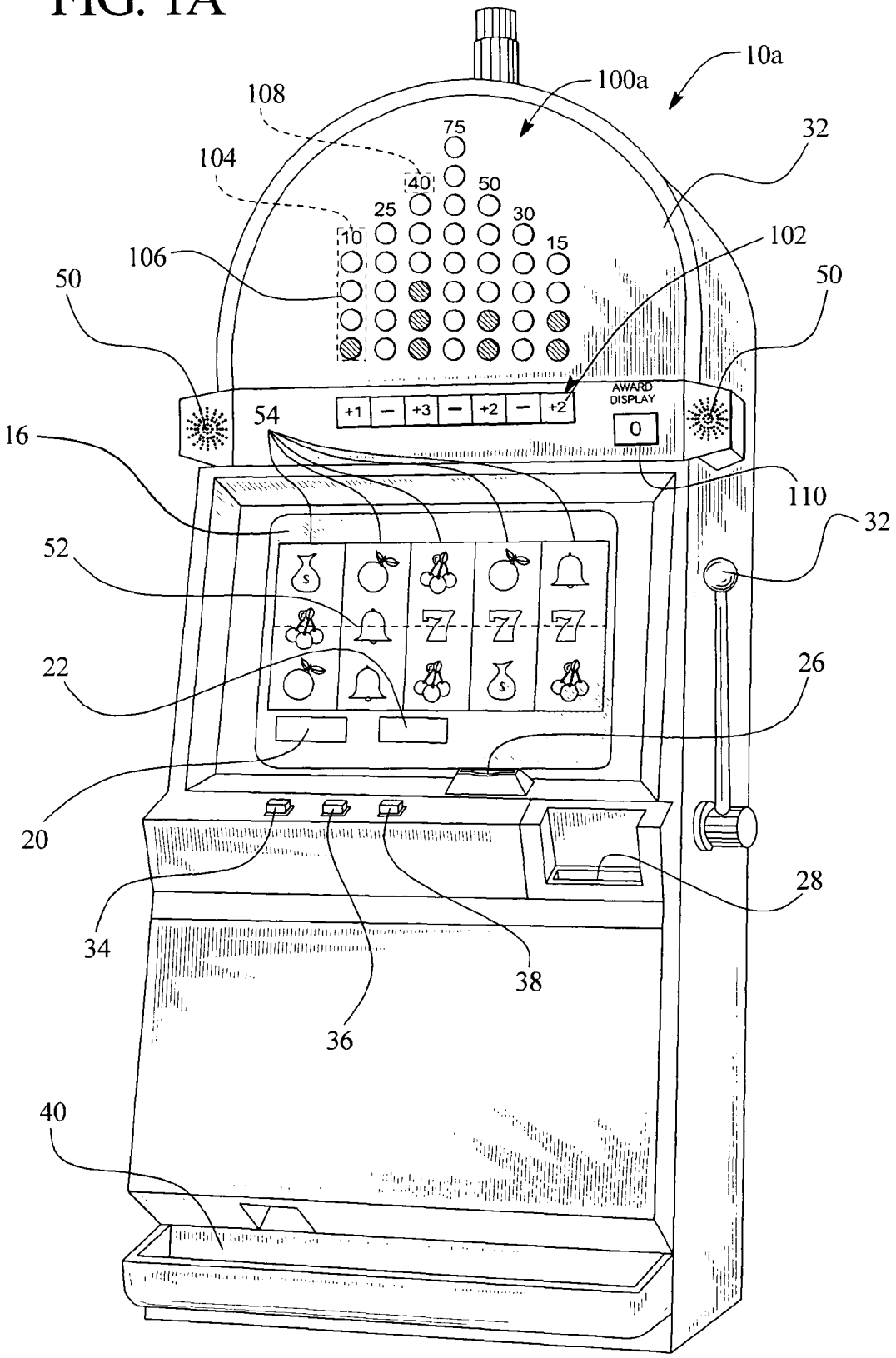
FIG. 1A is a front perspective view of one embodiment of the gaming device of the present invention.
Figure 1B:
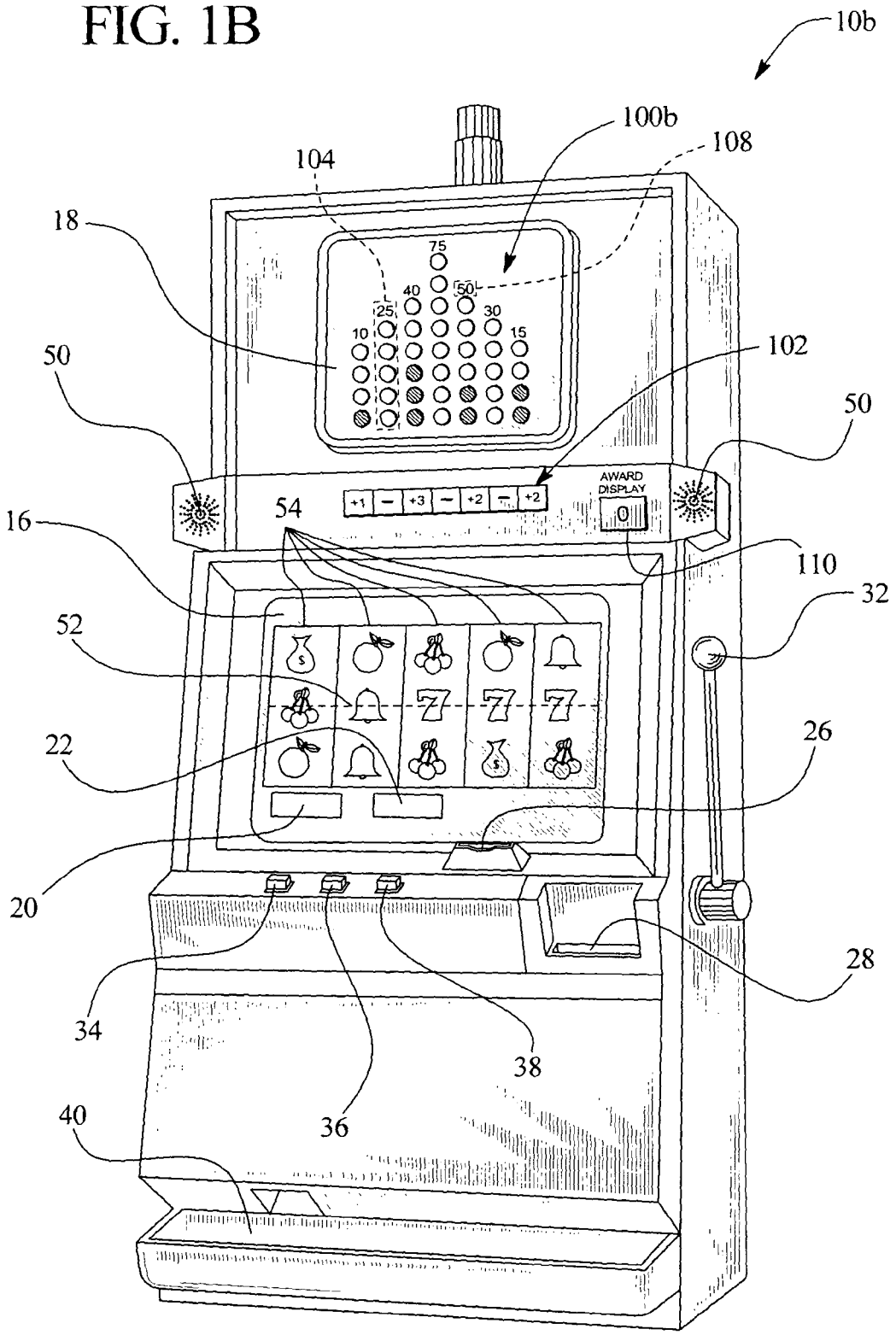
FIG. 1B is a front perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
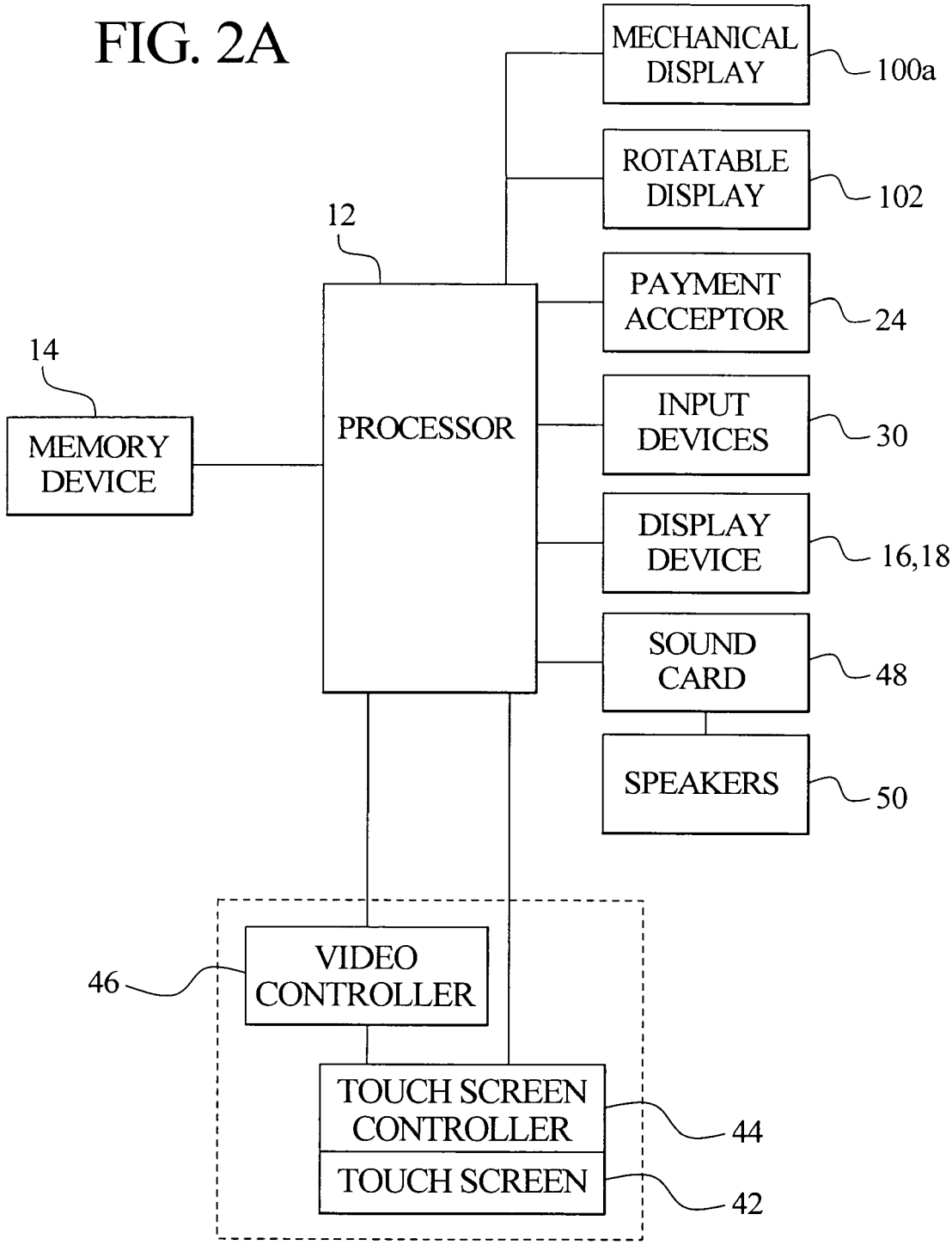
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Gaming device 10 can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into the present invention.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning pattern.

In one embodiment, a base or primary game may be a keno game wherein the gaming device displays a plurality of selectable indicia or numbers on at least one of the display devices. In this embodiment, the player selects at least one and preferable a plurality of the selectable indicia or numbers via an input device or via the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
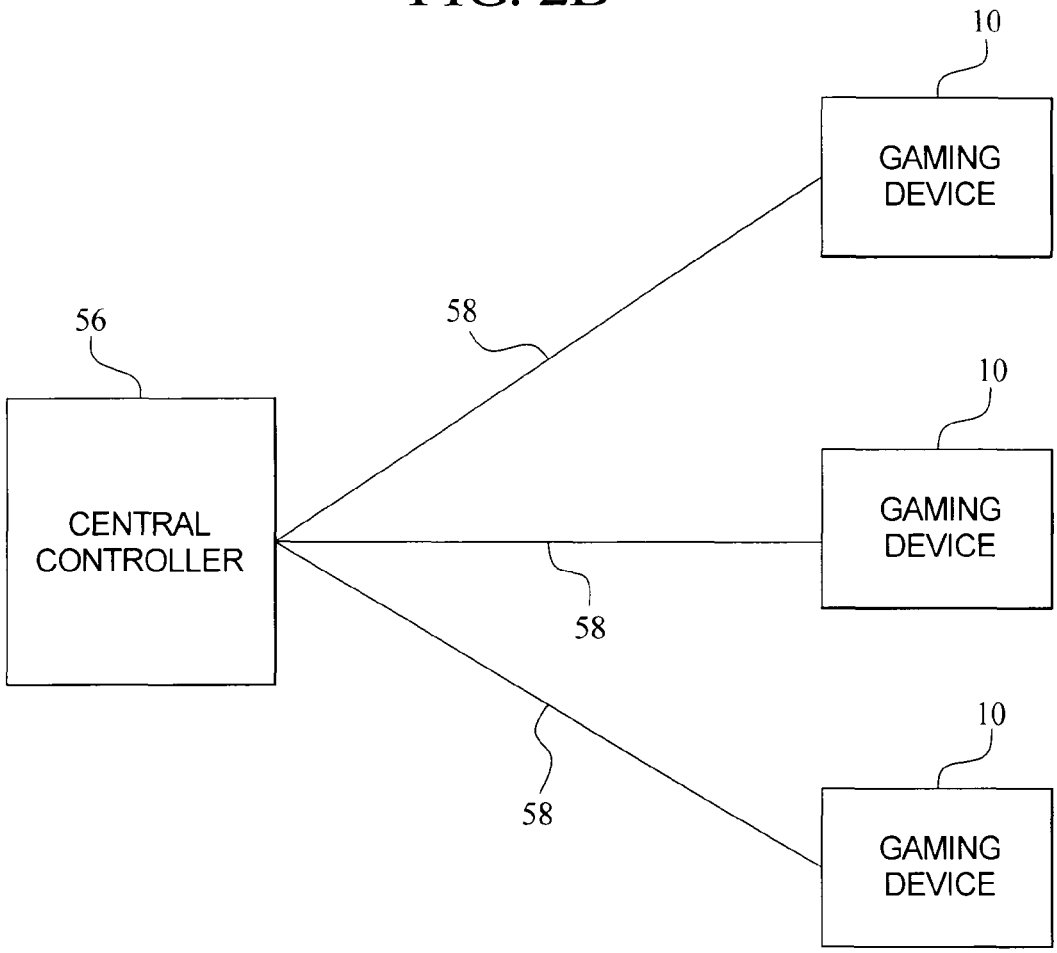
FIG. 2B is a schematic block diagram illustrating a plurality of gaming terminals and communication with a central controller.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an Internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

Accumulated Symbol Game

Referring now to FIGS. 1A, and 1B, in one embodiment the gaming device includes a secondary display device 100 which includes a plurality of award groups such as award columns 104 and an indicator generator 102. In one embodiment, the indicator generator 102 includes a plurality of numbers of indicators which are randomly aligned or associated with each of the award columns in a game. Each of the award groups or award columns 104 include a plurality of indicators 106. The gaming device indicates or accumulates a number of the indicators in each of the award columns based on the numbers of indicators generated and aligned with the award columns by the indicator generator. For example, if a number of indicators such as a plus three value is associated or aligned with an award column, then three of the indicators in that award column are indicated or accumulated. The gaming device provides any awards to a player associated with each of the award columns where all of the indicators of the award column or award columns are fully indicated or accumulated.

In one embodiment, the gaming device then independently determines whether to end the game or continue the game. If the gaming device determines to end the game, the player receives the total award accumulated in the game.

In one embodiment, if the gaming device determines not to end the game, the gaming device resets the indicators of the award columns including the provided awards and repeats the steps described above until all of the indicators of the same, different or any combination of the award columns are fully indicated or accumulated in the game. The gaming device does not reset the indicators of the award columns that do not include one of the provided awards. Therefore, the player only has to indicate any remaining indicators (i.e., indicators which are not indicated) in these award columns to obtain the award or awards associated with these award columns. The indicator generator continues to generate and align indicators with each of the award columns and the gaming device continues to accumulate the number of the indicators in each of the award columns based on the numbers of indicators generated and aligned with the award columns by the indicator generator. These steps continue until all of the indicators are indicated in at least one of the award columns and the gaming device determines to end the game. The present invention therefore increases a player's excitement and enjoyment of the game by enabling the player to accumulate one or several awards in the game and possibly to accumulate a relatively large award in the game.

Figure 3A:
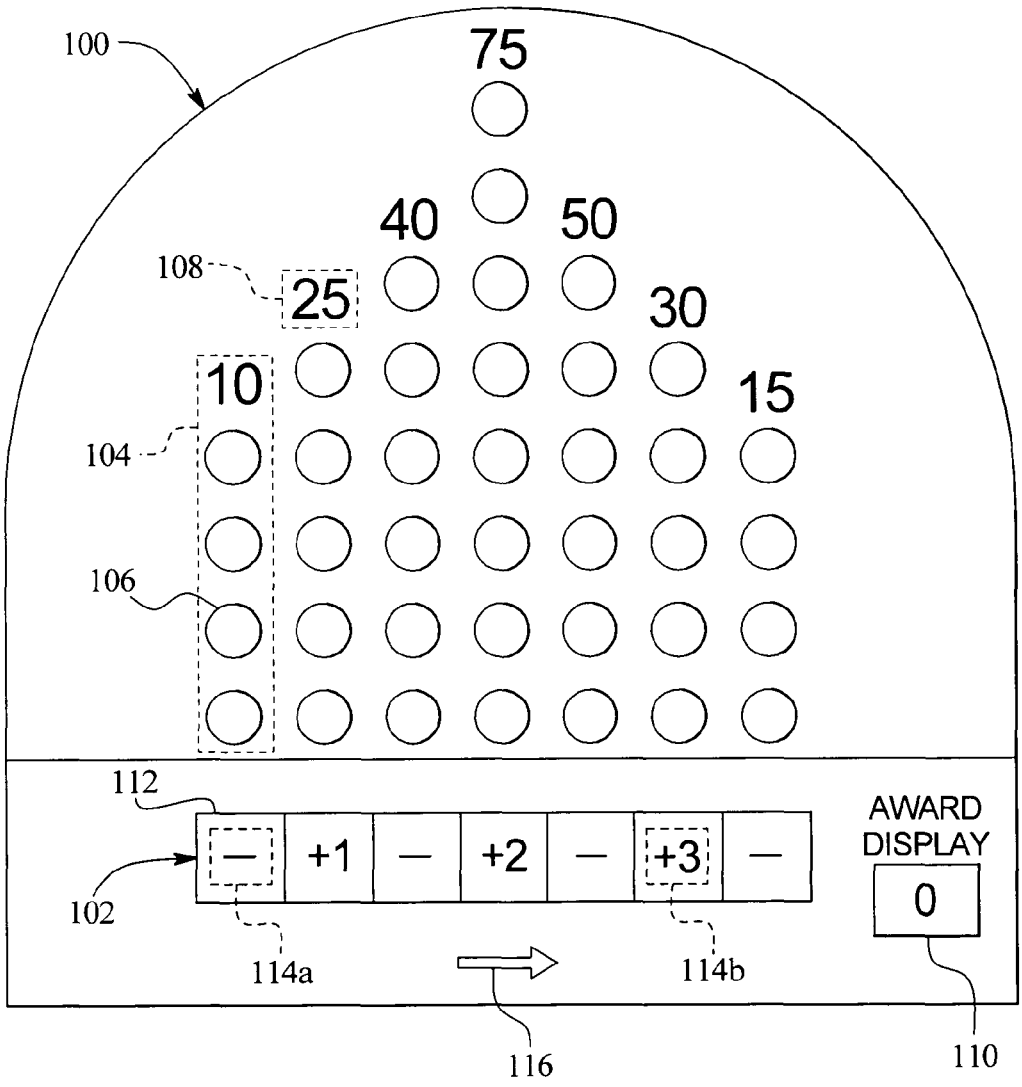
FIG. 3A is an enlarged elevation view of one of the display devices of FIGS. 1A and 1B illustrating one embodiment of the present invention.
Figure 3B:
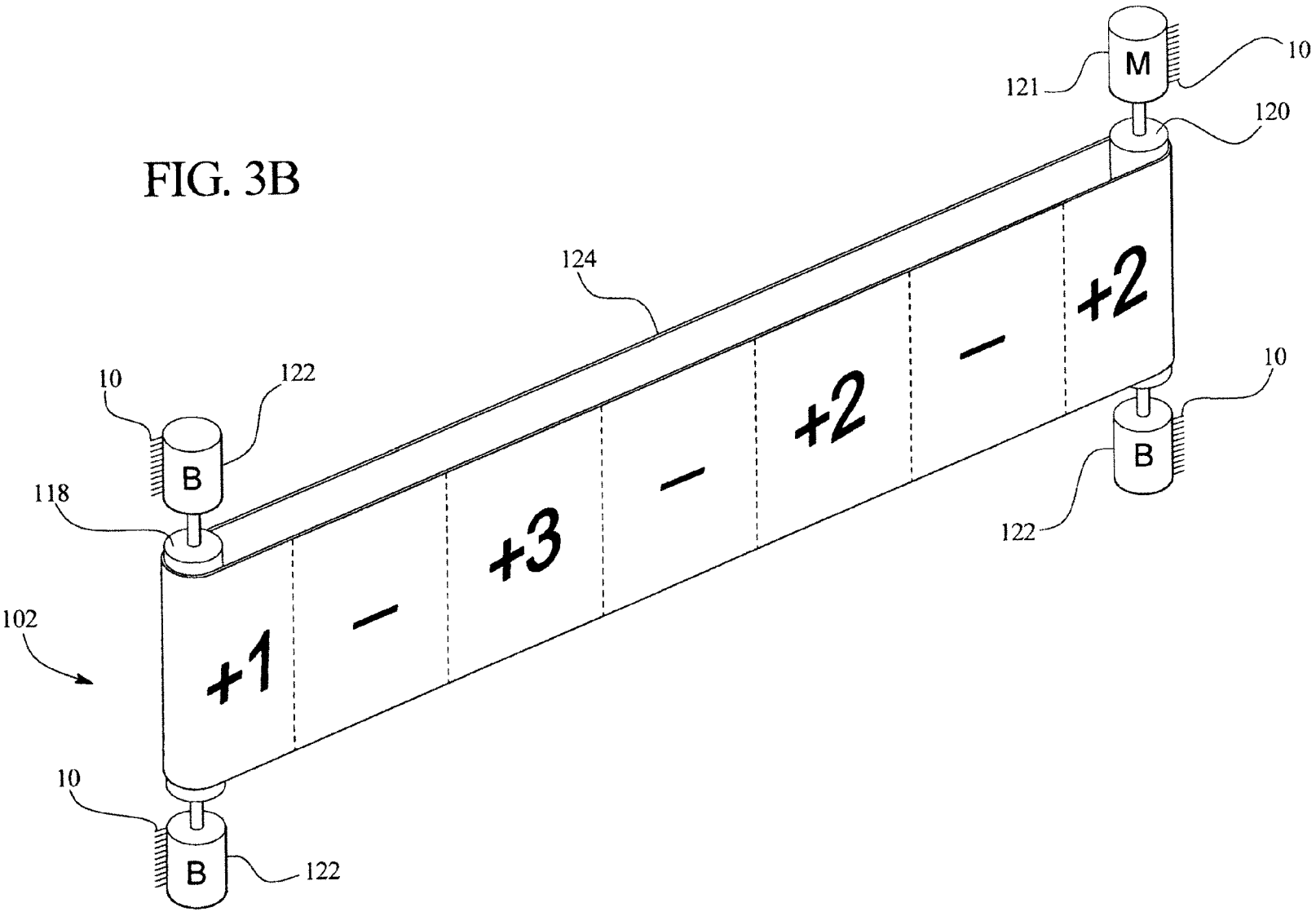
FIG. 3B is a front perspective view of an indicator generator associated with the embodiment of FIG. 3A employing two rollers and a belt in tension with such rollers.

Referring to FIGS. 3A and 3B, the secondary display device 100*a* is a mechanical display device as shown in FIG. 1A which is attached to the top of the cabinet of the gaming device 10. In another embodiment, the secondary display device 100 is a video display such as the video display device 100*b*. In this embodiment, the indicator generator 102 includes a rotatable display including one or more numbers of indicators. In another embodiment, the indicator generator 102 includes mechanical reel or a video reel. It should be appreciated that the indicator generator 102 may be any suitable display such as a reel, a plurality of reels or a wheel.

In one embodiment, the award columns 104 each include a plurality of indicators 106 and an award 108 which is positioned at the top of the column of indicators 106. Each of the award columns 104 may include one, two, three or any suitable number of indicators 106. In one embodiment, each indicator 106 is independently activated, indicated or otherwise accumulated in a game. In this embodiment, each indicator includes at least one illumination device such as a light emitting diode (L.E.D.) which is controlled by a processor associated with the gaming device. It should be appreciated that any suitable illumination device may be employed to illuminate or otherwise indicate the indicators 106 in a game.

In one embodiment, the award columns include at least one award 108. The awards may be modifiers, free games, free spins, game elements or any suitable award or awards. In one embodiment, the awards associated with each of the award columns 104 are different. In another embodiment, at least two of the awards associated with the award columns 104 are the same. In a further embodiment, at least one of the awards associated with the award columns 104 includes a relatively large award and the awards associated with the remaining award columns include relatively small awards. It should be appreciated that any suitable award or awards 108 may be associated with the award columns 104.

Referring to FIG. 3B, one embodiment of the indicator generator is illustrated where the indicator generator includes a rotatable display 102 having two rollers 118 and 120. One roller 118 is a drive roller and is suitably attached to a motor 121 and a bearing 122, which are fixed to the gaming device 10. The motor 121 can rotate the roller 118 in a clockwise direction (i.e., left to right), a counterclockwise direction (i.e., right to left), a combination of clockwise and counterclockwise directions, or as determined by the controller of gaming device 10. The motor 121 can be a stepper motor having a drive unit (not shown) and programmable indexer (not shown), which are well known in the art and enable the motor to precisely turn the drive roller 118 and position a belt 124. The second roller 120 is a follower roller and is suitably attached to two bearings 122, which are fixed to the gaming device 10. The follower roller 120 is driven by the belt 124, which frictionally engages the outer surface of the rollers 118 and 120, such that the belt 124 does not slip along the rollers 118 and 120 due to gravity or due to the rotation of the rollers. When the motor 121 drives roller 118, belt 124 moves and in turn rotates the follower roller 120.

Referring now to FIGS. 3A and 3B, the belt 124 includes a plurality of sections 112. In one embodiment, each section includes a number of indicators which are represented by a modifier or value such as a null value or zero value 114*a*, or a positive value such as the plus three value (114*b*) as show in FIG. 3A. In one embodiment, the sections 112 include a plurality of null values, a plus one value, a plus two value and a plus three value. In another embodiment, the sections 112 include null values, positive values, negative values or any combination of null values, positive values and negative values. It should be appreciated that any suitable values or modifiers may be associated with the sections 112. An arrow 116 indicates the rotational direction of the rotatable display 102. As shown in FIG. 3A, the rotatable display rotates from the left to the right as a player views the front of the gaming device. In another embodiment, the rotatable display 102 rotates from the right to the left. In a further embodiment, the rotatable display 102 alternately rotates from the left to the right and the right to the left in a game. It should be appreciated that the rotatable display 102 may rotate in any suitable direction. It should further be appreciated that the rotatable display 102 may be a horizontal reel, a vertical reel, a reel configured in any suitable orientation, a plurality of reels, a wheel or wheels or any other suitable movable display on the secondary display device 100.

In one embodiment, an award display 110 indicates any award or awards obtained by the player in the game. The award indicated by the award display 110 is added to the player's total award in the game.

In one embodiment, the gaming device enables the player to accumulate, illuminate or otherwise indicate the indicators 106 in one or more of the award columns 104. The indicators 106 in each of the award columns 104 are independently activated or indicated according to the value 114 associated with the sections 112 on the rotatable display 102 that are aligned with the award columns 104. As shown in FIG. 3A, each award column 104 has a corresponding section 112 on the rotatable display 102 which is positioned under and adjacent to the award columns. In one embodiment, the section 112 associated or aligned with each of the award columns 104 includes a number of indicators such as a null value 114*a*, or a modifier such as a positive value 114*b*. As described above, the modifier may be a positive value, a negative value, a positive or negative value combined with a multiplier or any other suitable modifier desired by the game implementor.

In one embodiment, the gaming device rotates the rotatable display 102 in the direction shown by arrow 116. The gaming device then stops the rotatable display and randomly aligns the sections 112 of the display with each of the award columns 104. The gaming device then illuminates or otherwise indicates the indicators 106 in each of the award columns 104 based on the values 114 associated with the award columns 104. For example, in FIG. 3A, the left-most award column is associated with a null value or zero value 114*a*. Therefore, the gaming device does not illuminate or indicate any of the indicators 106 associated with that award column. Similarly, a positive value (i.e., plus three value) is associated with the award column having the award of thirty. Therefore, the gaming device illuminates or indicates three of the indicators 106 associated with that award column.

In one embodiment, when a designated number such as all of the indicators associated with one or more of the award columns are fully illuminated, indicated or accumulated in a game, the gaming device provides the award or awards associated with those award columns to the player. The gaming device then determines whether to end the game or continue the game. If the gaming device determines to end the game, the player receives any accumulated awards and the game ends.

If the gaming device determines not to end the game (or to continue the game), the gaming device resets the indicators associated with the award columns including the provided award or awards (i.e., de-illuminates, de-activates or otherwise eliminates the accumulation of the indicators in the award columns). The indicators of the award columns which did not include any of the provided awards are not reset and therefore maintain any indicators that were previously illuminated or otherwise indicated in the game. In one embodiment, any award columns where only a portion of the indicators 106 (i.e., less than all of the indicators) are illuminated or indicated, remain illuminated for the remainder of the game. It should be appreciated that the gaming device may reset one indicator, a plurality of indicators or all of the indicators in one or more of the award columns in a game.

The above steps are repeated until all of the indicators 106 are fully illuminated or indicated for the same, different or any combination of the award columns in the game and the gaming device determines to end the game. It should be appreciated that that the sequence may repeat a plurality or number of times such that all of the indicators associated with one or more of the award columns may be fully illuminated or indicated in a game one or more times.

In one embodiment, a probability of ending a game (or alternatively, a probability of continuing the game) is associated with the game. The gaming device determines whether to end or continue the game based on the probability. In one aspect of this embodiment, the probability changes each time the indicators in one or more of the award columns are fully indicated and the award or awards associated with those award columns are provided to a player. In another aspect of this embodiment, the probability changes after a plurality of times which the indicators in one or more of the award columns are fully indicated and the award or awards associated with those award columns are provided to a player. It should be appreciated that the probability of ending the game may change by a random amount or a pre-determined amount in a game or games. It should also be appreciated that the probability of ending the game may increase, decrease or remain the same in one or more games.

Figure 4A:
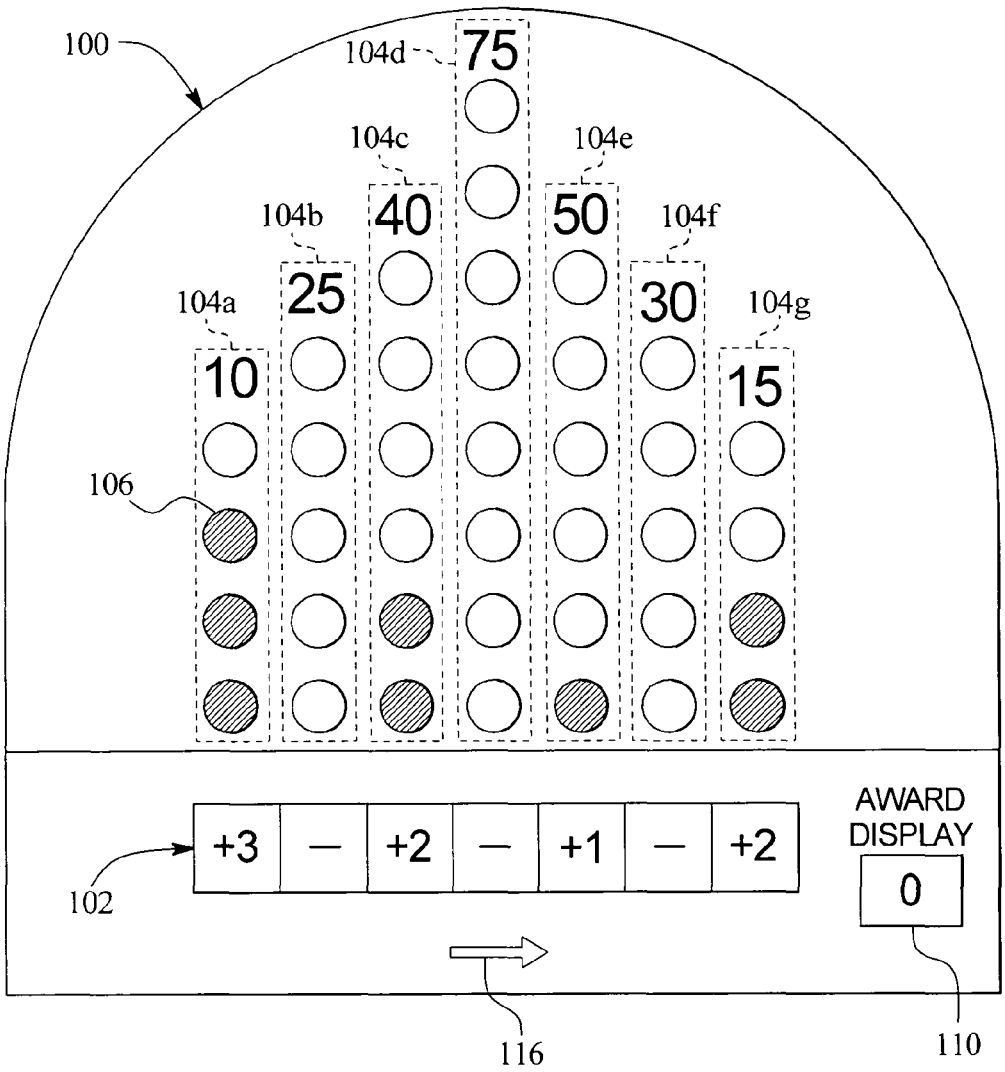
FIGS. 4A, 4B, 4C and 4D are enlarged elevation views of one of the display devices of FIG. 1A or 1B illustrating an example of the embodiment of FIG. 3A.

Referring now to FIGS. 4A to 4D, an example of the embodiment of FIG. 3A is illustrated where the gaming device initially displays seven award groups such as the award columns 104*a*, 104*b*, 104*c*, 104*d*, 104*e*, 104*f* and 104*g* to the player as shown in FIG. 4A. The award columns do not include any indicators 106 which are illuminated or indicated at the start of the game. However, it should be appreciated that one or more of the indicators may be illuminated or otherwise indicated at the beginning of a game.

Referring to FIG. 4A, the gaming device causes the indicator generator such as the rotatable display 102 to rotate and associate values with the award columns for the first time in the game. The rotatable display stops rotating and indicates a number of indicators such as a null value or a positive value for each of the award columns 104 on the display device 100. Specifically, a value of plus three is associated with award column 104*a*, a null value or zero value is associated with award column 104*b*, a plus two value is associated with the award column 104*c*, a null value is associated with the award column 104*d*, a plus one value is associated with the award column 104*e*, a null value is associated with the award column 104*f* and a plus two value is associated with the award column 104*g*. In each of the award columns 104, a number of indicators 106 are illuminated or indicated which correspond to the value on the rotatable display 102 associated with the award columns. For example, the value associated with award column 104*a* is plus three. Therefore, three of the indicators 106 are illuminated or indicated in award column 104*a* as shown in FIG. 4A.

In one embodiment, the indicators are illuminated or indicated starting with the bottom-most indicator and going upward towards the top of the award column. In another embodiment, the indicator on the top of the award column is illuminated first and then each successive indicator going towards the bottom of the award column are illuminated. It should be appreciated that any suitable order of indicators may be illuminated or indicated in a game. Similar to award column 104*a*, the indicators 106 in award columns 104*c*, 104*e* and 104*g* are illuminated or indicated based on the value associated with those award columns on the rotatable display 102. The indicators of the award columns 104*b*, 104*d* and 104*f*, which are associated with null values, are not illuminated or indicated because the null value is equivalent to a zero value. Because all of the indicators in one or more of the award columns are not illuminated in the game, the gaming device continues to rotate the rotatable display 102 in the game.

Figure 4B:
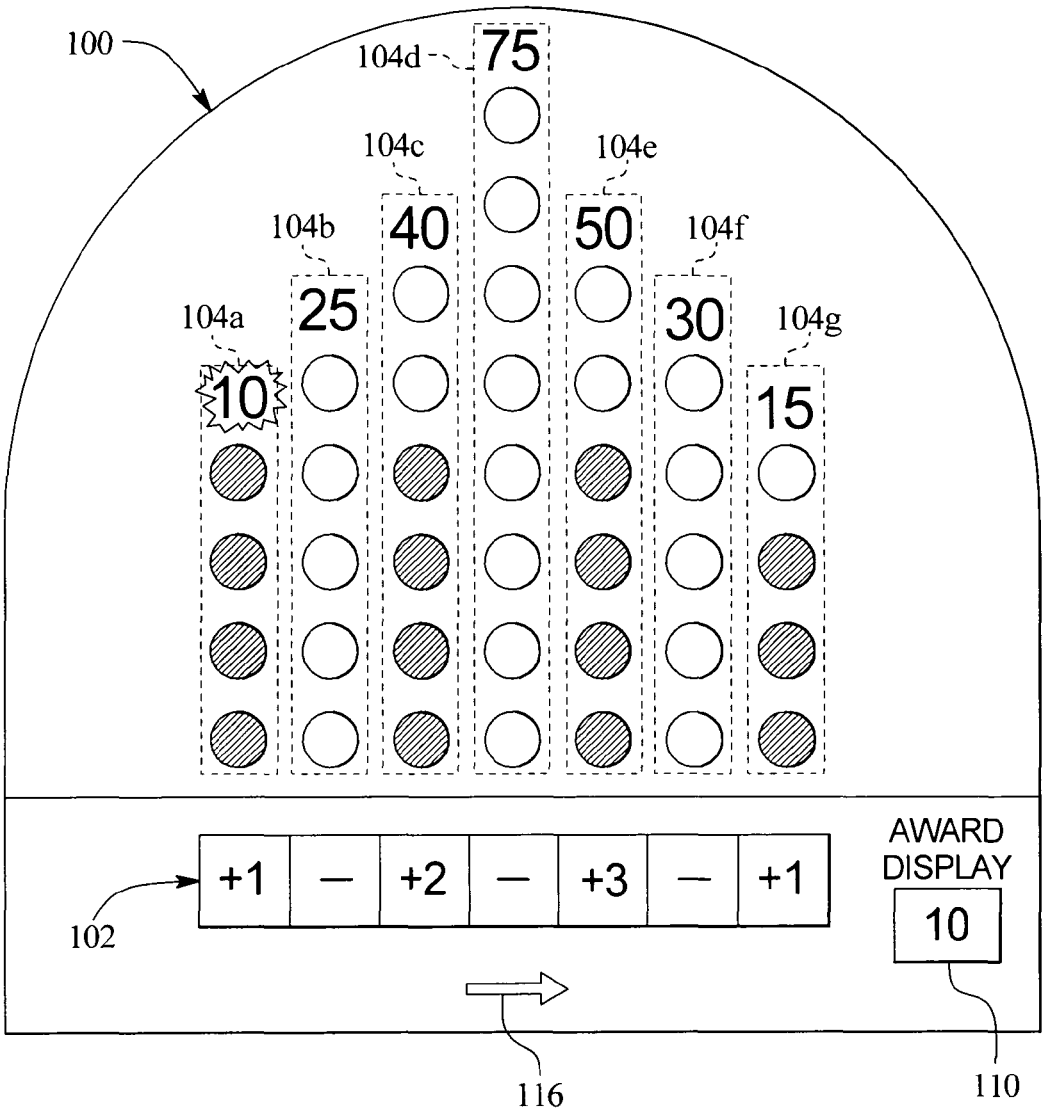

Referring to FIG. 4B, the gaming device causes the rotatable display 102 to rotate and associate or align values with each of the award columns for a second time in the game. The rotatable display stops rotating and associates values with each of the award columns. Specifically, a plus one value is associated with award column 104*a*, a null value is associated with award column 104*b*, a plus two value is associated with award column 104*c*, a null value is associated with award column 104*d*, a plus three value is associated with award column 104*e*, a null value is associated with award column 104*f* and a plus one value is associated with award column 104*g*. As described above, the corresponding number of indicators in each of the award columns 104 are illuminated based on the value associated with each of those award columns. Specifically, all of the indicators 106 of award column 104*a* are illuminated or indicated. The gaming device provides the award of ten, which is associated with award column 104*a*, to the player as indicated by the award display 110.

The gaming device then determines whether to end the game. The player hopes that the gaming device does not end the game so that the player can accumulate more awards in the game. In this example, the gaming determines not to end the game and therefore resets the indicators in award column 104*a* (i.e., de-illuminates the indicators or eliminates the accumulated indicators) prior to causing the rotatable display to rotate again and associate more values with the award columns in the game. The gaming device does not reset or eliminate the accumulated indicators in award columns 104*b*, 104*c*, 104*d*, 104*e*, 104*f* and 104*g*.

Figure 4C:
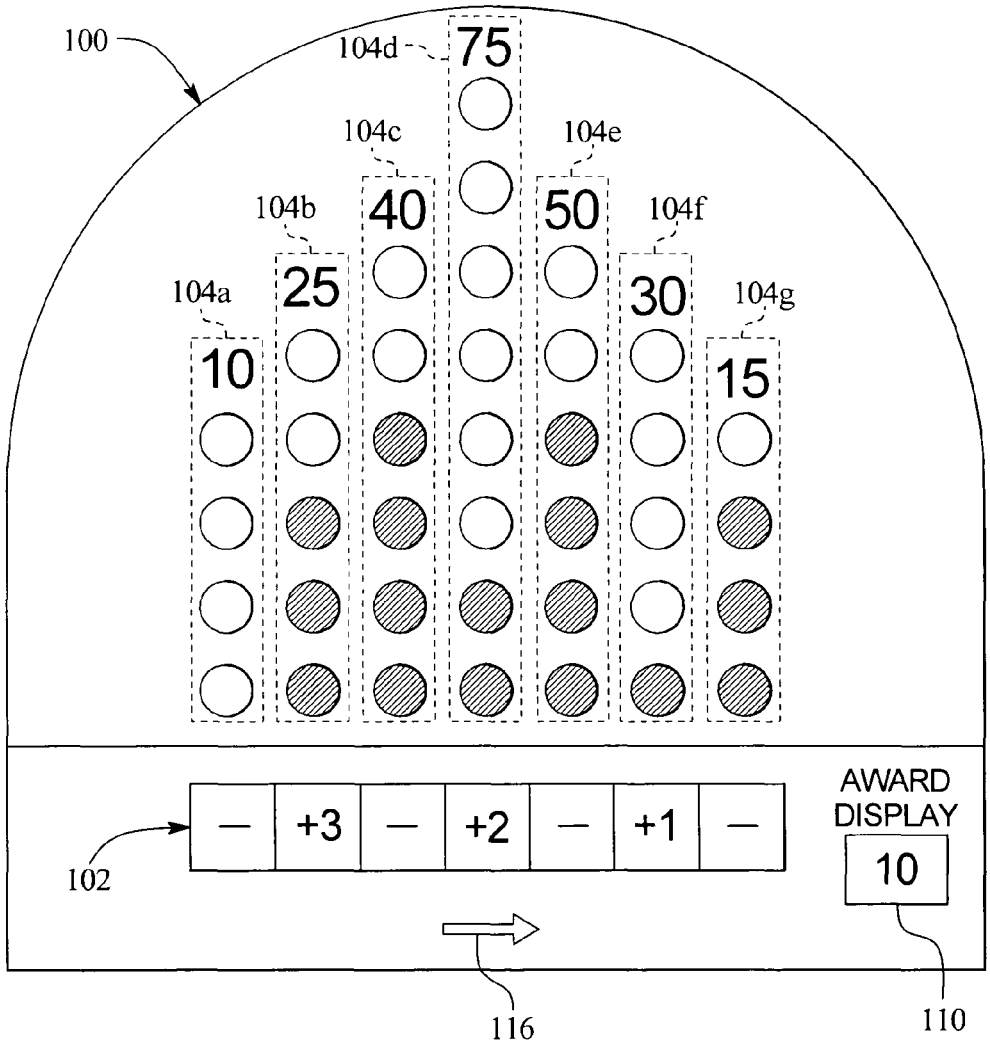

Referring to FIG. 4C, the gaming device causes the rotatable display 102 to rotate and associate values with the award columns for a third time in the game. The rotatable display 102 stops and indicates values for each of the award columns 104. Specifically, a null value is associated with award column 104*a*, a plus three value is associated with award column 104*b*, a null value is associated with award column 104*c*, a plus two value is associated with award column 104*d*, a null value is associated with award column 104*e*, a plus one value is associated with award column 104*f* and a null value is associated with award column 104*g*. Because all of the indicators of one or more of the award columns have not been illuminated or accumulated, the gaming device will cause the rotatable display 102 to rotate at least one more time in the game. The player only needs to illuminate or indicate one more indicator in award column 104*g* and two more indicators in award columns 104*b*, 104*c* and 104*e*. Therefore, the player's excitement and enjoyment increases because the player has the opportunity to obtain at least one and possibly four more awards in the game.

Figure 4D:
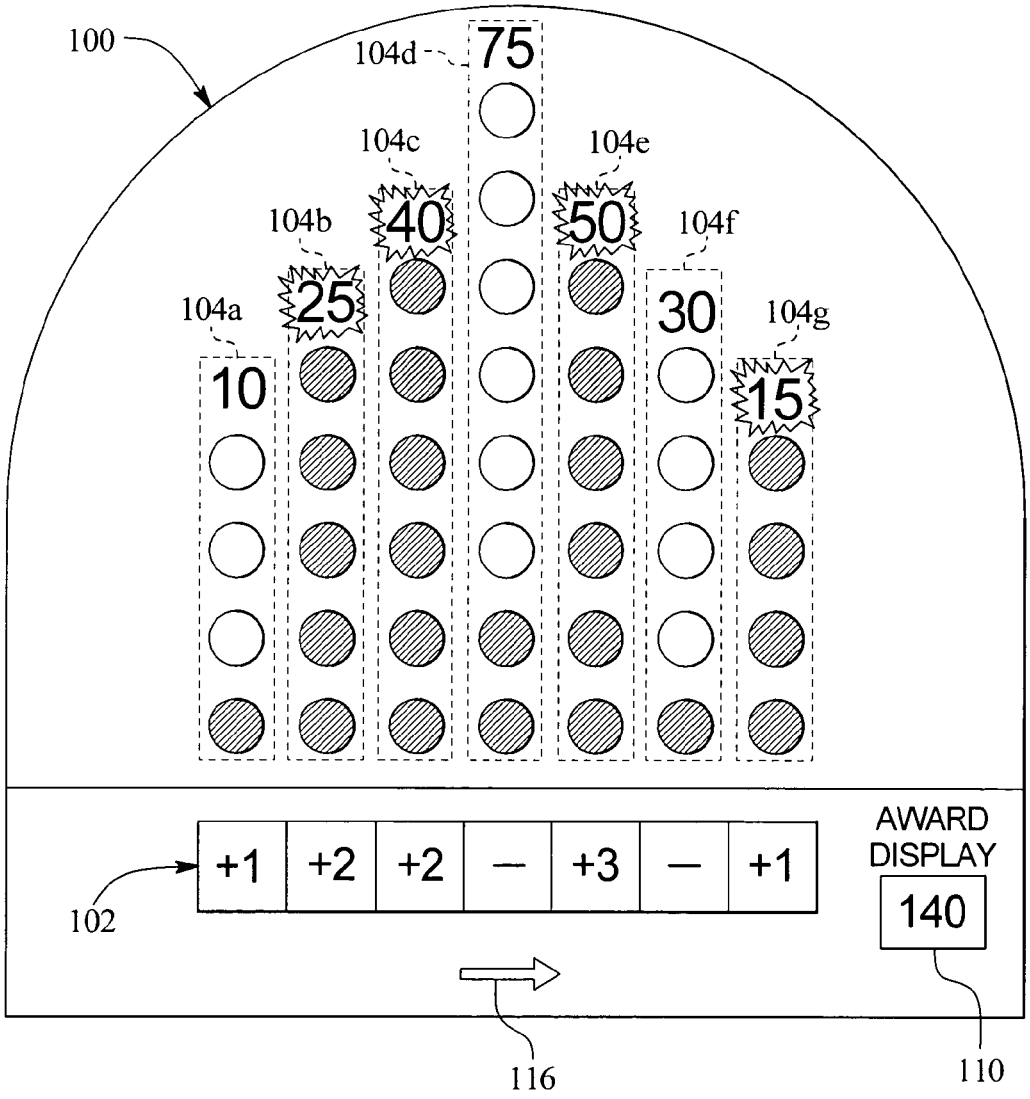

Referring to FIG. 4D, the gaming device causes the rotatable display to rotate and associate values with the award columns for a fourth time in the game. In particular, a plus one value is associated with award column 104*a*, and plus two value is associated with award column 104*b*, a plus two value is associated with award column 104*c*, a null value is associated with award column 104*d*, a plus three value is associated with award column 104*e*, a null value is associated with award column 104*f* and a plus one value is associated with award column 104*g*. The corresponding number of indicators in each of the award columns are illuminated or indicated based on the number of indicators associated with those award columns. After the indicators are illuminated, all of the indicators associated with award columns 104*b*, 104*c*, 104*e* and 104*g* are fully illuminated or indicated. Therefore, the gaming device provides the awards of twenty-five, forty, fifty and fifteen associated with these award columns to the player. The player's new total or accumulated award in the game is one hundred forty as indicated by the award display 110. Because all of the indicators associated with at least one of the award columns have been illuminated, the gaming device determines whether to end the game. In this example, the gaming device determines to end the game. The player receives the accumulated award of one hundred forty as indicated by the award display 110 and the game ends.

In one alternative embodiment, when a designated number such as all of the indicators associated with one or more of the award columns are fully illuminated, indicated or accumulated in a game, the gaming device indicates the awards associated with those award columns and determines whether to provide the indicated awards to the player. If the gaming device determines not to provide the indicated award or awards to the player, the indicated awards are not provided to the player. The gaming device then resets only the indicators associated with the award columns including the indicated awards. The indicators of the award columns which did not include any of the indicated awards are not reset and therefore maintain any indicators that were previously illuminated or otherwise indicated in the game. In one embodiment, any award columns where only a portion of the indicators 106 (i.e., less than all of the indicators) are illuminated or indicated, remain illuminated for the remainder of the game.

When the indicated award or awards are not provided to the player, the gaming device re-activates or rotates the rotatable display. The above steps are repeated until all of the indicators 106 are fully illuminated or indicated for the same, different or any combination of the award columns in the game and the gaming device determines to provide the indicated award or awards to the player. After the award or awards are provided to the player, the game ends.

In one embodiment, a probability of providing the awards to the player is associated with the awards 108 where the gaming device determines whether to provide an indicated award or awards to a player as described above based on the probability associated with the indicated award or awards. In one embodiment, the probabilities associated with the awards are the same. In another embodiment, at least one of the probabilities associated with the awards is different from the probabilities associated with the other awards. In a further embodiment, all of the probabilities associated with the awards are different. It should be appreciated that the probabilities associated with the awards may be any suitable probabilities desired by the game implementor. In this embodiment, the probabilities determine whether the gaming device will provide an indicated award or awards to a player (i.e., whether a player will collect or receive any awards associated with award columns where all of the indicators in the award columns are fully indicated). If the gaming device determines that the indicated award or awards are to be provided to the player based on the probability associated with those awards, the gaming device provides the award or awards to the player.

Figure 5A:
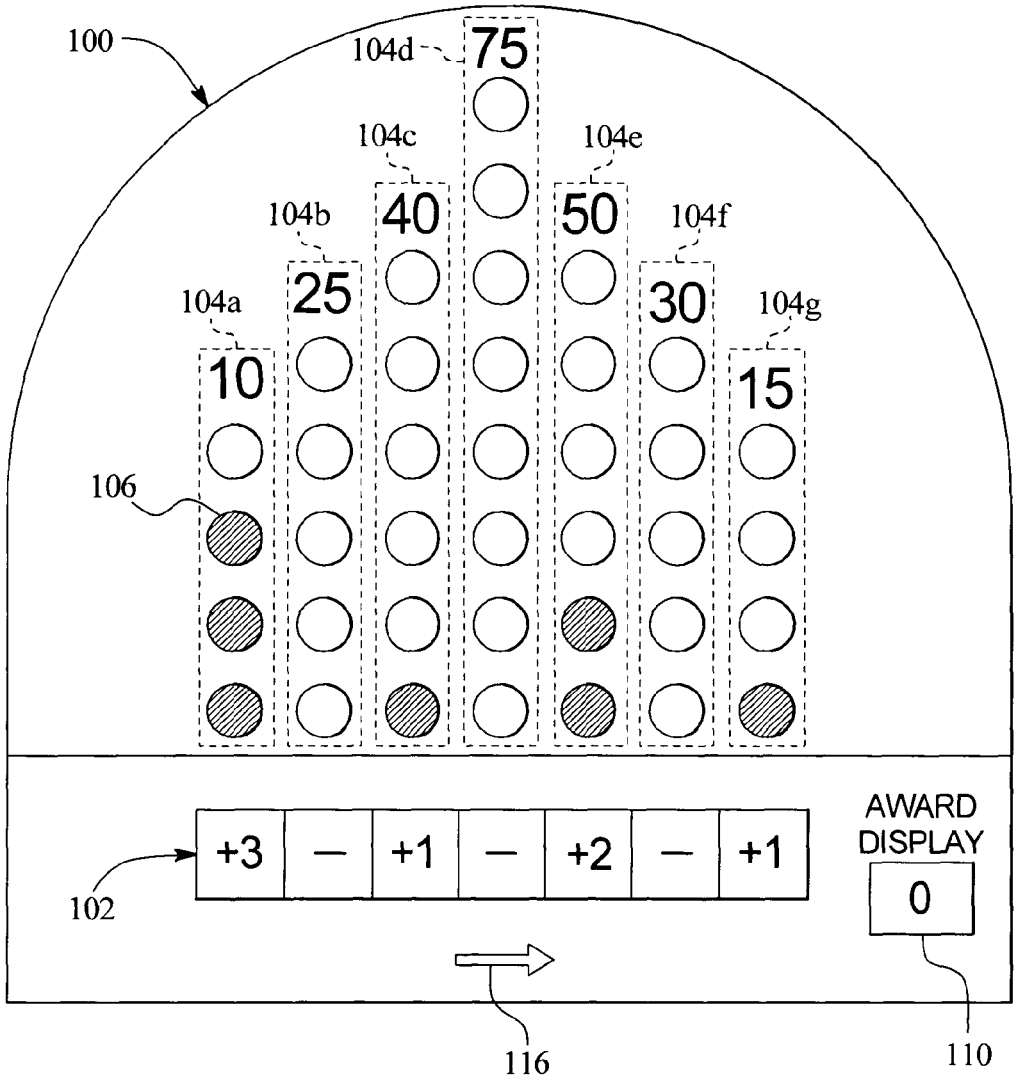
FIGS. 5A, 5B, 5C, 5D, 5E, 5F and 5G are enlarged elevation views of one of the display devices of FIG. 1A or 1B illustrating an example of an alternative embodiment of the present invention.

Referring now to FIGS. 5A to 5G, an example of the alternative embodiment is illustrated where the gaming device initially displays seven award groups such as the award columns 104*a*, 104*b*, 104*c*, 104*d*, 104*e*, 104*f* and 104*g* to the player as shown in FIG. 5A. The award columns do not include any indicators 106 which are illuminated or indicated at the start of the game. However, it should be appreciated that one or more of the indicators may be illuminated or otherwise indicated at the beginning of a game.

Referring to FIG. 5A, the gaming device causes the indicator generator such as the rotatable display 102 to rotate and associate values with the award columns for the first time in the game. The rotatable display stops rotating and indicates a number of indicators such as a null value or a positive value for each of the award columns 104 on the display device 100. Specifically, a value of plus three is associated with award column 104*a*, a null value or zero value is associated with award column 104*b*, a plus one value is associated with the award column 104*c*, a null value is associated with the award column 104*d*, a plus two value is associated with the award column 104*e*, a null value is associated with the award column 104*f* and a plus one value is associated with the award column 104*g*. In each of the award columns 104, a number of indicators 106 are illuminated or indicated which correspond to the value on the rotatable display 102 associated with the award columns. For example, the value associated with award column 104*a* is plus three. Therefore, three of the indicators 106 are illuminated or indicated in award column 104*a* as shown in FIG. 5A.

Similar to award column 104*a*, the indicators 106 in award columns 104*c*, 104*e* and 104*g* are illuminated or indicated based on the value associated with those award columns on the rotatable display 102. The indicators of the award columns 104*b*, 104*d* and 104*f*, which are associated with null values, are not illuminated or indicated because the null value is equivalent to a zero value. Because all of the indicators in one or more of the award columns are not illuminated in the game, the gaming device continues to rotate the rotatable display 102 in the game.

Figure 5B:
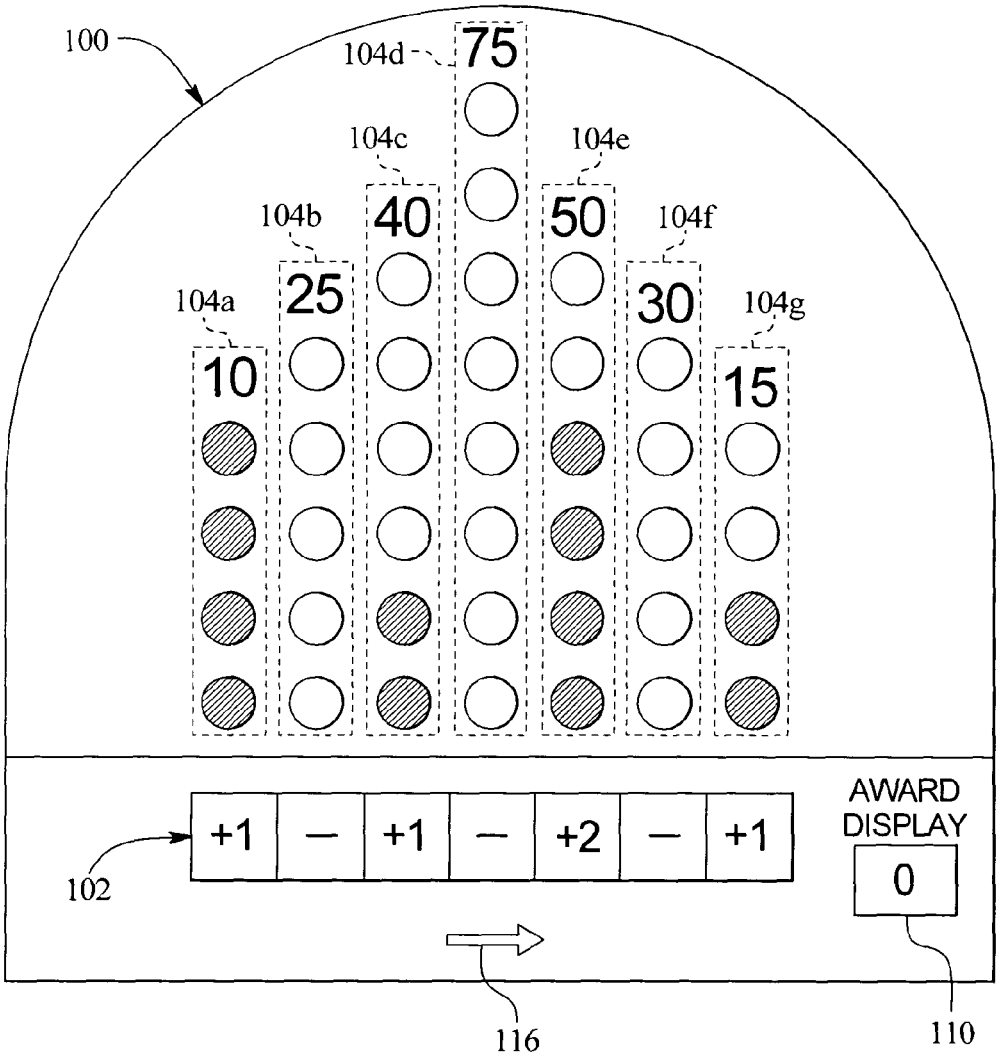

Referring to FIG. 5B, the gaming device causes the rotatable display 102 to rotate and associate or align values with each of the award columns for a second time in the game. The rotatable display stops rotating and associates values with each of the award columns. Specifically, a plus one value is associated with award column 104*a*, a null value is associated with award column 104*b*, a plus one value is associated with award column 104*c*, a null value is associated with award column 104*d*, a plus two value is associated with award column 104*e*, a null value is associated with award column 104*f* and a plus one value is associated with award column 104*g*. As described above, the corresponding number of indicators in each of the award columns 104 are illuminated based on the value associated with each of those award columns. Specifically, all of the indicators 106 of award column 104*a* are illuminated or indicated. The gaming device indicates the award of ten associated with award column 104*a* and determines whether to provide the award of ten to the player based on the probability associated with this award. Because the award of ten is not the largest award on the display device, the player hopes that the gaming device does not provide this award so the player has an opportunity to obtain one or more of the larger awards in the game. In this example, the gaming determines not to provide the award of ten to the player. The gaming device resets the indicators in award column 104*a* (i.e., de-illuminates the indicators or eliminates the accumulated indicators) prior to causing the rotatable display to rotate and associate more values with the award columns in the game. The gaming device does not reset or eliminate the accumulated indicators in award columns 104*b*, 104*c*, 104*d*, 104*e*, 104*f* and 104*g*. In one alternative embodiment, the game can be employed as an offer and acceptance type game, where the player can accept an award or a plurality of the awards and stop the game, or reject the award or awards and continue the game.

Figure 5C:
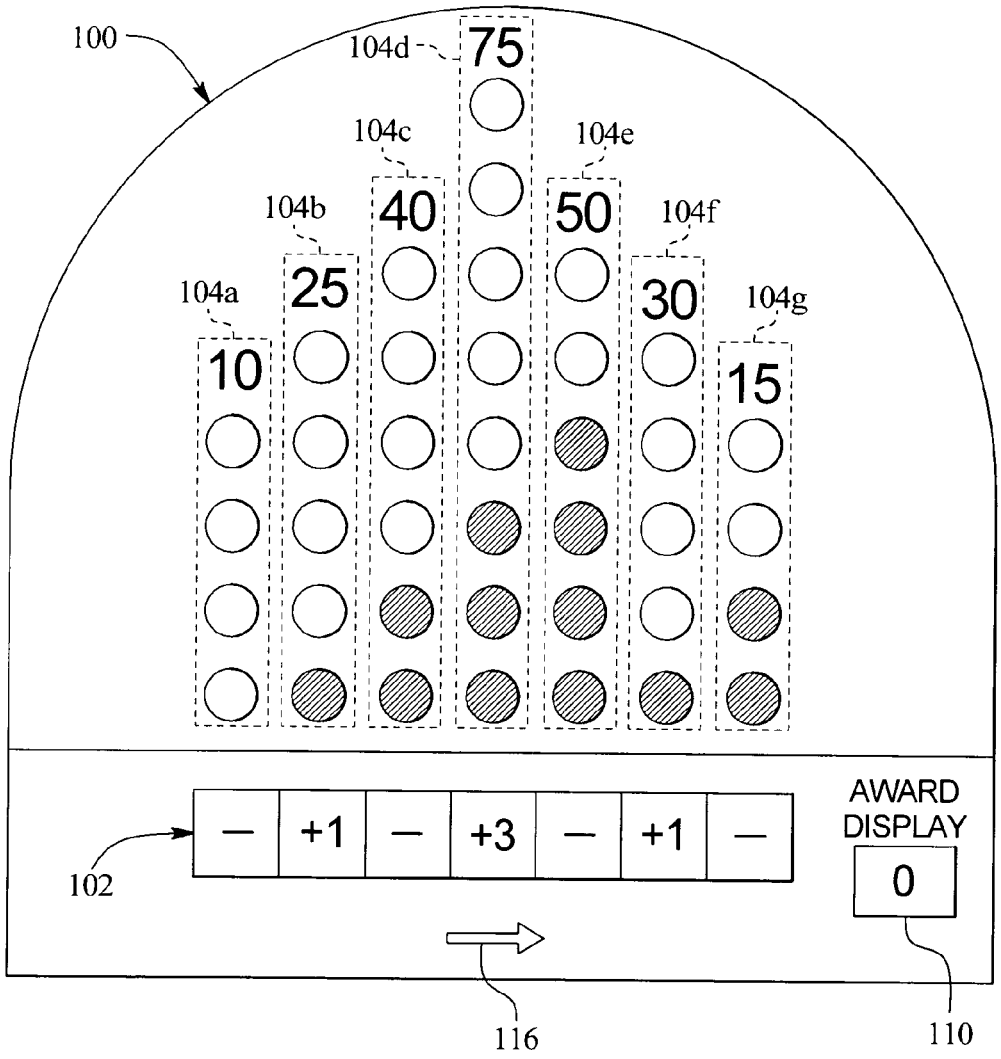

Referring to FIG. 5C, the gaming device causes the rotatable display 102 to rotate and associate values with the award columns for a third time in the game. The rotatable display 102 stops and indicates values for each of the award columns 104. Specifically, a null value is associated with award column 104*a*, a plus one value is associated with award column 104*b*, a null value is associated with award column 104*c*, a plus three value is associated with award column 104*d*, a null value is associated with award column 104*e*, a plus one value is associated with award column 104*f* and a null value is associated with award column 104*g*. Because all of the indicators of one or more of the award columns have not been illuminated or accumulated, the gaming device will cause the rotatable display 102 to rotate at least one more time in the game. The player only needs to illuminate or indicate two more indicators in award columns 104*e* and 104*g*. Therefore, the player's excitement and enjoyment increases because the player has the opportunity to obtain at least one and possibly two awards in the game.

Figure 5D:
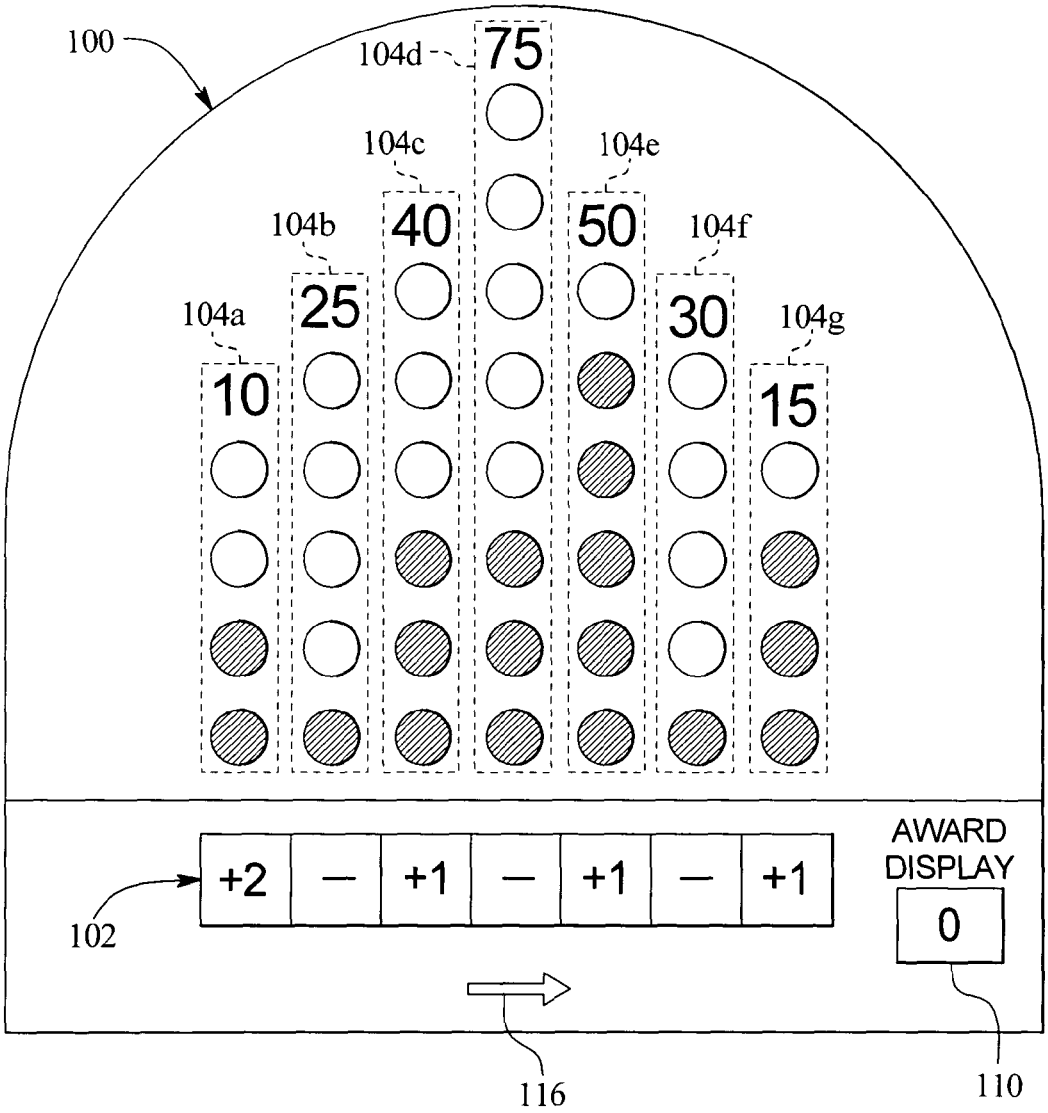

Referring to FIG. 5D, the gaming device causes the rotatable display to rotate and associate values with the award columns for a fourth time in the game. In particular, a plus two value is associated with award column 104*a*, and null value is associated with award column 104*b*, a plus one value is associated with award column 104*c*, a null value is associated with award column 104*d*, a plus one value is associated with award column 104*e*, a null value is associated with award column 104*f* and a plus one value is associated with award column 104*g*. The corresponding number of indicators in each of the award columns are illuminated or indicated based on the number of indicators associated with those award columns. After the indicators are illuminated, the player only needs to obtain one more indicator in award column 104*e*. Similarly, the player only needs to obtain one more indicator in award column 104*g*. Because all of the indicators associated with at least one of the award columns have not been illuminated, the gaming device will cause the rotatable display to rotate for another time in the game.

Figure 5E:
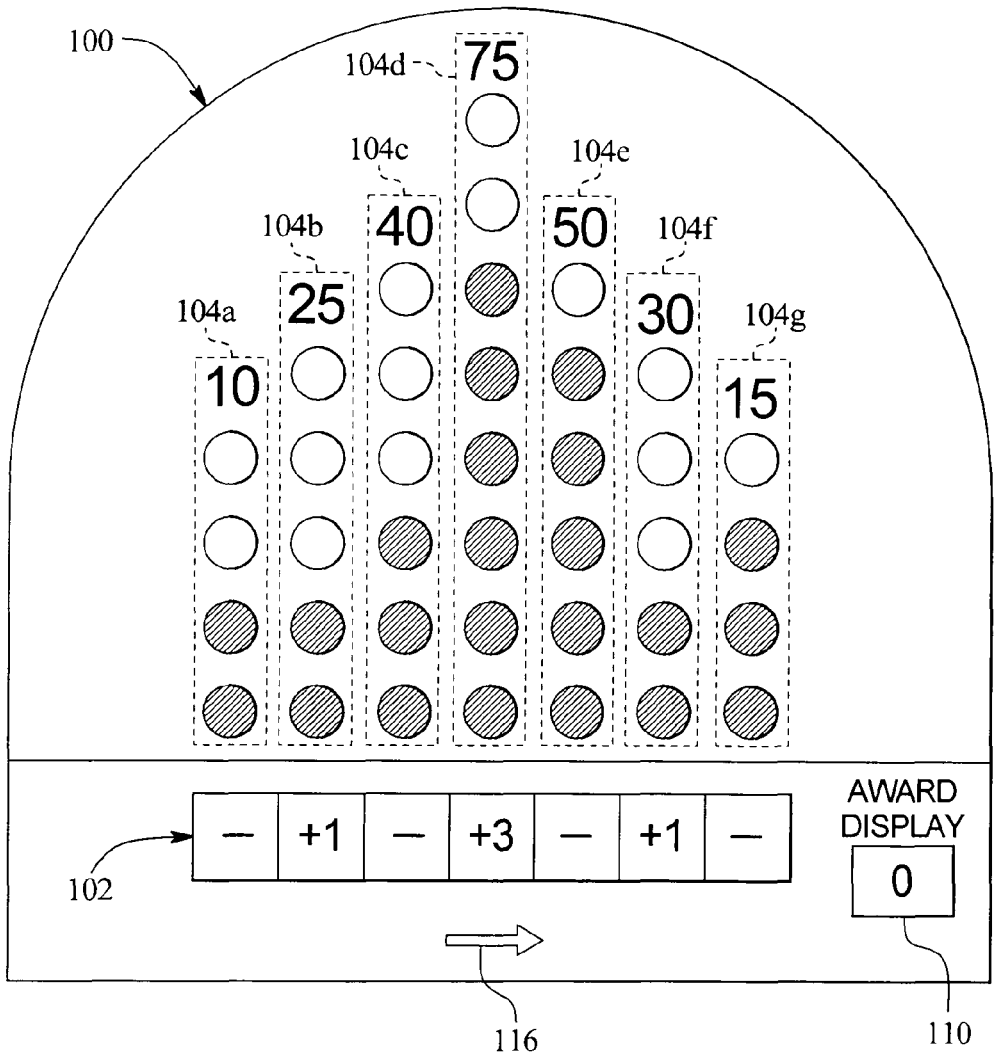

Referring to FIG. 5E, the gaming device causes the rotatable display to rotate and associate a number of indicators with the award columns for a fifth time in the game. Specifically, a null value is associated with 104*a*, a plus one value is associated with award column 104*b*, a null value is associated with award column 104*c*, a plus three value is associated with award column 104*d*, a null value is associated with award column 104*e*, a plus one value is associated with award column 104*f* and a null value is associated with award column 104*g*. The corresponding indicators in each of the award columns are illuminated. None of the indicators in any of the award columns have been fully illuminated in the game. However, the player only needs to obtain two more indicators to illuminate all of the indicators in award column 104*d* and the player only needs to obtain one more indicator to illuminate all of the indicators in the award column 104*e* and in award column 104*g*. Therefore, the player's excitement and enjoyment level further increases because the player is very close to illuminating all of the indicators in three of the award columns in the game. Thus, the player will have an opportunity to obtain at least one award and possibly three awards in the game.

Figure 5F:
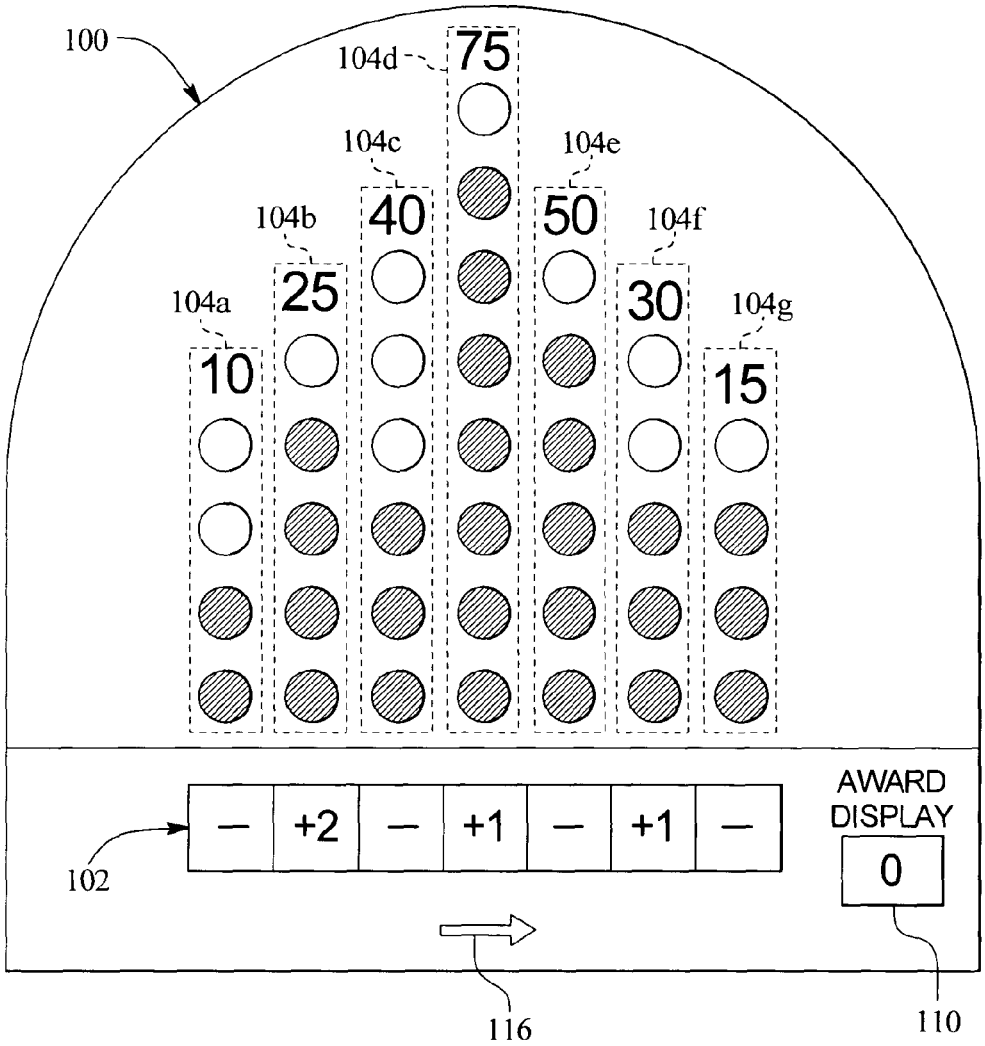

Referring to FIG. 5F, the gaming device causes the rotatable display to rotate for a sixth time in the game. The rotatable display stops rotating and associates a number of indicators with each of the award columns. In particular, a null value is associated with award column 104*a*, a plus two value is associated with award column 104*b*, a null value is associated with award column 104*c*, a plus one value is associated with award column 104*d*, a null value is associated with award column 104*e*, a plus one value is associated with award column 104*f*, and a null value is associated with award column 104*g*. The corresponding number of indicators associated with each of the award columns are illuminated in the game. As a result, two of the award columns 104*a* and 104*f* only need two more indicators to be illuminated to fully illuminate or indicate the indicators in those award columns. Additionally, only one more indicator must be illuminated in four of the award columns 104*b*, 104*d*, 104*e* and 104*g* for these award columns to be fully illuminated in the game. Therefore, the player has the possibility of obtaining at least one award and possibly several awards in the game. This further increases the player's excitement and enjoyment of the game. Because all of the indicators associated with any one of the award columns are not illuminated yet in the game, the gaming device will rotate the rotatable display for another time in the game.

Figure 5G:
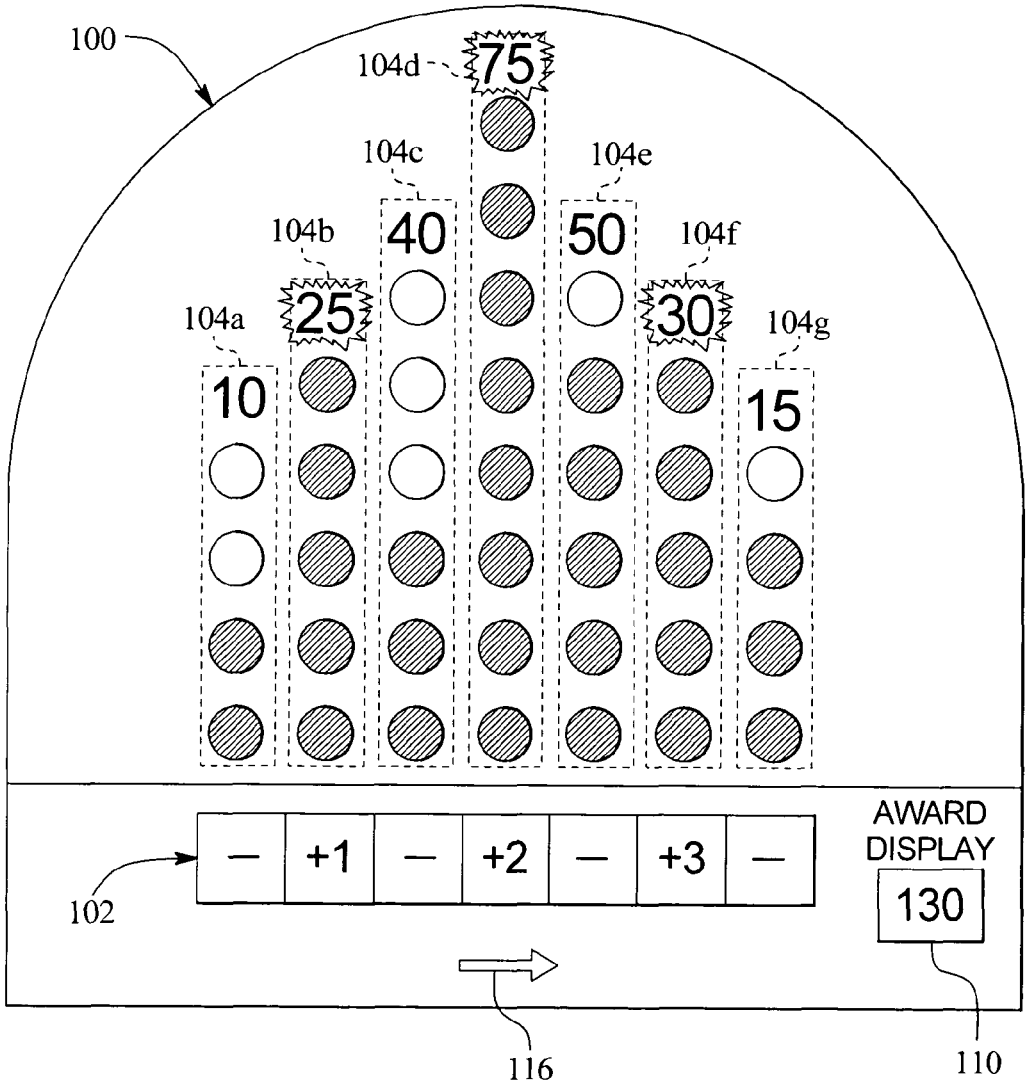

Referring to FIG. 5G, the gaming device causes the rotatable display 102 to rotate and associate a number of indicators with the award columns for a seventh time in the game. Specifically, a null value is associated with award column 104*a*, a plus one value is associated with award column 104*b*, a null value is associated with award column 104*c*, a plus two value is associated with award column 104*d*, a null value is associated with award column 104*e*, a plus three value is associated with award column 104*f*, and a null value is associated with award column 104*g*. The corresponding number of indicators in each of the award columns 104 are illuminated based on the number of indicators associated with those award columns. All of the indicators 106 in three of the award columns 104*b*, 104*d* and 104*e* are fully illuminated or indicated (i.e., all of the indicators have been accumulated) in the game. The gaming device indicates or highlights these awards and determines whether to provide these three awards to the player.

As illustrated in FIG. 5G, the gaming device determines to provide the awards of twenty-five, seventy-five and thirty to the player in the game. Therefore, the total accumulated award of one hundred thirty is added to the award display 110. The game ends and the player receives the total award indicated in the award display 110. As described above the gaming device did not provide the award of ten to the player earlier in the game, but instead, provided a much larger award of one hundred thirty to the player.

In another embodiment, the gaming device provides the largest award to the player when all the indicators associated with a plurality of award columns are fully illuminated in a game. It should be appreciated that the gaming device may provide one, a plurality of or all of the awards associated with the award columns where all of the indicators in those award columns are fully illuminated or fully accumulated in a game and the gaming device determines that those awards will be provided to the player. In another embodiment, the gaming device determines whether to provide one, a plurality of or all of the awards associated with the award columns to the player based on the probabilities associated with the award columns in the game.

It should be appreciated that the present invention may be employed in a primary game, a bonus game, free spins game, a sub-game or in any suitable game.

It should be appreciated that the increments in the illustrated embodiment are dependent on each other (i.e., they are arranged in a particular order and always occur or are generated in that particular order). Therefore, the indicators which are selected for the awards are related to each other based on the dependencies of the various increments. It should be appreciated that in other embodiments one, a plurality of, or all of the increments can be independently generated with out dependency on the other increments.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

at least one display device;

at least one input device;

at least one processor; and at least one memory device which stores a plurality of instructions which when executed by the at least one processor cause the at least one processor to operate with the at least one display device and the at least one input device, for a single play of a game, to:

(a) enable a player to place a wager for said single play of the game, said game associated with a plurality of displayed award groups, each of said award groups including at least one indicator, a plurality of said award groups including a plurality of indicators, each of the award groups associated with at least one of a plurality of awards;

(b) cause an indicator generator of the at least one display device to generate and associate a number of indicators with each of the award groups;

(c) for each of the award groups, accumulate a quantity of indicators corresponding to the number of indicators that is associated with that award group by the indicator generator;

(d) without requiring any additional wager by the player, repeat (b) to (c) until all of the indicators have been accumulated in at least one of the award groups; and (e) when all of the indicators have been accumulated in at least one of the award groups:

(i) provide to the player the awards associated with any award groups in which all of the indicators have been accumulated, (ii) after providing the awards associated with any award groups in which all of the indicators have been accumulated to the player, randomly determine whether to end the single play of the game, and (iii) if it is randomly determined not to end the single play of the game:

(A) reset the indicators in the award groups associated with the awards provided to the player in said single play of the game, and (B) after resetting the indicators in the award groups associated with the awards provided to the player in said single play of the game, provide the player with at least one opportunity to win at least one additional award for accumulating all of the indicators in at least one of the award groups, including any award groups associated with any awards previously provided to the player in said single play of the game, by repeating (b) to (e) until it is determined to end the single play of the game without requiring any additional wager by the player.

2. The gaming device of claim 1, wherein the indicator generator includes at least one reel.

3. The gaming device of claim 1, wherein the indicator generator includes a mechanical wheel.

4. The gaming device of claim 1, which includes a substantially transparent plate including different color sections which is positioned adjacent to the indicator generator.

5. The gaming device of claim 1, which includes a probability of ending the game associated with the game.

6. The gaming device of claim 5, wherein the probability of ending the game is randomly determined.

7. The gaming device of claim 5, wherein the probability of ending the game is pre-determined.

8. The gaming device of claim 5, wherein the probability of ending the game is determined based on the wager made by the player.

9. The gaming device of claim 5, wherein the probability of ending the game changes after each time all of the indicators have been accumulated in at least one of said award groups.

10. The gaming device of claim 5, wherein the probability of ending the game changes after a plurality of times all of the indicators have been accumulated in at least one of said award groups.

11. The gaming device of claim 1, which includes at least one illumination device connected to each of the indicators.

12. The gaming device of claim 11, wherein the illumination devices include different color lights.

13. The gaming device of claim 12, wherein the illumination devices connected to the indicators of at least two of the award groups include different color lights.

14. The gaming device of claim 1, wherein the plurality of instructions, when executed by the at least one processor, cause the at least one processor to cause the indicator generator to randomly generate the numbers of indicators associated with each of the award groups.

15. The gaming device of claim 1, wherein the plurality of instructions, when executed by the at least one processor, cause the at least one processor to cause the indicator generator to generate the numbers of indicators associated with each of the award groups based on the wager made by the player.

16. The gaming device of claim 1, wherein the plurality of instructions, when executed by the at least one processor, cause the at least one processor to reset at least one of the indicators in at least one of the award groups when the award associated with the award group is provided to the player.

17. A gaming device comprising:

a plurality of display devices including a first display device and a rotatable display;

at least one input device;

at least one processor; and at least one memory device which stores a plurality of instructions which when executed by the at least one processor cause the at least one processor to operate with the plurality of display devices and the at least one input device, for a single play of a game, to:

(a) enable a player to place a wager for said single play of the game, said game associated with a plurality of displayed award groups, each of said award groups including at least one indicator, a plurality of said award groups including a plurality of indicators, wherein each of the award groups is associated with at least one of a plurality of awards;

(b) cause the rotatable display to rotate, said rotatable display positioned adjacent to the award groups and including a plurality of static values, each of said values corresponding to a number of indicators;

(c) cause the rotatable display to stop and align one of the values with each of the award groups;

(d) for each of the award groups, accumulate the number of indicators corresponding to the value aligned with that award group;

(e) without requiring any additional wager by the player, repeat (b) to (d) until all of the indicators have been accumulated in at least one of the award groups; and (f) when all of the indicators have been accumulated at least one of the award groups:

(i) provide to the player the awards associated with any award groups in which all of the indicators have been accumulated, (ii) after providing to the player the awards associated with any award groups in which all of the indicators have been accumulated, randomly determine whether to end the single play of game, and (iii) if it is randomly determined not to end the single play of the game:

(A) reset the indicators in the award groups associated with the awards provided to the player in said single play of the game, and (B) after resetting the indicators in the award groups associated with the awards provided to the player in said single play of the game, provide the player with at least one opportunity to win at least one additional award for accumulating all of the indicators in at least one of the award groups, including any award groups associated with any awards previously provided to the player in said single play of the game, by repeating (b) to (f) until it is determined to end the single play of the game without requiring any additional wager by the player.

18. The gaming device of claim 17, which includes a substantially transparent plate including different color sections which is positioned adjacent to the rotatable display.

19. The gaming device of claim 17, which includes a probability of ending the game associated with the game.

20. The gaming device of claim 19, wherein the probability of ending the game is randomly determined.

21. The gaming device of claim 19, wherein the probability of ending the game is pre-determined.

22. The gaming device of claim 19, wherein the probability of ending the game is determined based on the wager made by the player.

23. The gaming device of claim 19, wherein the probability of ending the game changes after each time all of the indicators have been accumulated in at least one of said award groups.

24. The gaming device of claim 19, wherein the probability of ending the game changes after a plurality of times all of the indicators have been accumulated in at least one of said award groups.

25. The gaming device of claim 17, which includes at least one illumination device connected to each of the indicators.

26. The gaming device of claim 25, wherein the illumination devices include different color lights.

27. The gaming device of claim 25, wherein the illumination devices connected to the indicators of at least two of the award groups include different color lights.

28. The gaming device of claim 17, wherein the values aligned with each of the award groups are randomly generated.

29. The gaming device of claim 17, wherein the values aligned with each of the award groups are generated based on the wager made by the player.

30. A gaming device comprising:

at least one display device;

at least one input device;

at least one processor; and at least one memory device which stores a plurality of instructions which when executed by the at least one processor cause the at least one processor to operate with the at least one display device and the at least one input device for a single play of a game to:

(a) enable a player to place a wager on said single play of the game, said game associated with a plurality of displayed award groups, each of said award groups including at least one indicator, a plurality of said award groups including a plurality of indicators, each of the award groups associated with at least one of a plurality of awards, (b) cause an indicator generator of the at least one display device to generate and associate a number of indicators with each of the award groups, (c) accumulate a quantity of indicators in each of the award groups corresponding to the number of indicators associated with that award group by the indicator generator, (d) without requiring any additional wager by the player, repeat (b) to (c) until all of the indicators have been accumulated in at least one of the award groups, and (e) when all of the indicators have been accumulated in at least one of said award groups:

(i) indicate the awards associated with any award groups in which all of the indicators have been accumulated, (ii) randomly determine whether to provide any of the indicated awards to a player, (iii) if it is determined not to provide the indicated awards to the player:

(A) reset the indicators in the award groups associated with the indicated awards, and (B) repeat (b) to (e) until it is determined to provide the indicated awards to the player without requiring any additional wager by the player, and (iv) if it is determined to provide the indicated awards to the player, provide any indicated awards to the player and terminate said single play of the game.

31. The gaming device of claim 30, which includes a probability of providing an award to a player associated with each of the awards.

32. The gaming device of claim 31, wherein the probability of providing the awards to the player is randomly determined.

33. The gaming device of claim 31, wherein the probability of providing the awards to the player is pre-determined.

34. The gaming device of claim 31, wherein the probability of providing the awards to the player is determined based on the wager made by the player.

35. The gaming device of claim 31, wherein at least two of the probabilities associated with the awards are different.

36. The gaming device of claim 31, wherein all of the probabilities associated with the awards are different.

37. The gaming device of claim 30, which includes at least one illumination device connected to each of the indicators.

38. The gaming device of claim 37, wherein the illumination devices include different color lights.

39. The gaming device of claim 38, wherein the illumination devices connected to the indicators of at least two of the award groups include different color lights.

40. The gaming device of claim 30, wherein the plurality of instruction, when executed by the at least one processor, cause the at least one processor to cause the indicator generator to randomly generate the numbers of indicators associated with each of the award groups.

41. The gaming device of claim 30, wherein the plurality of instruction, when executed by the at least one processor, cause the at least one processor to cause the indicator generator to generate the numbers of indicators associated with each of the award groups based on the wager made by the player.

42. The gaming device of claim 30, wherein the plurality of instruction, when executed by the at least one processor, cause the at least one processor to reset at least one of the indicators in at least one of the award groups associated with an indicated award when it is determined that the indicated award is not to be provided to the player.

43. A gaming device comprising:

a plurality of display devices including a first display device and a rotatable display;

at least one input device;

at least one processor; and at least one memory device which stores a plurality of instructions which when executed by the at least one processor cause the at least one processor to operate with the plurality of display devices and the at least one input device, for a single play of a game, to:

(a) enable a player to place a wager on said single play of the game, said game associated with a plurality of displayed award groups, each of said award groups including at least one indicator, a plurality of said award groups including a plurality of indicators wherein each of the award groups is associated with at least one of a plurality of awards;

(b) cause the rotatable display to rotate, said rotatable display positioned adjacent to the award groups and including a plurality of static values, each of said values corresponding to a number of indicators;

(c) cause the rotatable display to stop and align one of the values with each of the award groups;

(d) for each of the award groups, accumulate the number of indicators corresponding to the value aligned with that award group, (e) without requiring any additional wager by the player, repeat (b) to (d) until all of the indicators have been accumulated in at least one of the award groups;

(f) when all of the indicators have been accumulated in at least one of said award groups:

(i) indicate the awards associated with any award groups in which all of the indicators have been accumulated, (ii) randomly determine whether to provide any of the indicated awards to a player, (iii) if it is determined not to provide the indicated awards to the player;

(A) reset the indicators in the award groups associated with the indicated awards, and (B) repeat (b) to (f) until it is determined to provide the indicated awards to the player without requiring any additional wager by the player, and (iv) if it is determined to provide the indicated awards to the player, provide any indicated awards to the player and terminate said single play of the game.

44. The gaming device of claim 43, which includes a substantially transparent plate including different color sections which is positioned adjacent to the rotatable display.

45. The gaming device of claim 43, which includes a probability of providing an award to a player associated with each of the awards associated with the award groups.

46. The gaming device of claim 45, wherein the probability of providing the awards to the player is randomly determined.

47. The gaming device of claim 45, wherein the probability of providing the awards to the player is pre-determined.

48. The gaming device of claim 45, wherein the probability of providing the awards to the player is determined based on the wager made by the player.

49. The gaming device of claim 45, wherein at least two of the probabilities associated with the awards are different.

50. The gaming device of claim 45, wherein all of the probabilities associated with the awards are different.

51. The gaming device of claim 43, which includes at least one illumination device connected to each of the indicators.

52. The gaming device of claim 51, wherein the illumination devices include different color lights.

53. The gaming device of claim 51, wherein the illumination devices connected to the indicators of at least two of the award groups include different color lights.

54. The gaming device of claim 43, wherein the values aligned with each of the award groups are randomly generated.

55. The gaming device of claim 43, wherein the values aligned with each of the award groups are generated based on the wager made by the player.

56. The gaming device of claim 43, wherein the plurality of instructions, when executed by the at least one processor, cause the at least one processor to reset at least one of the indicators in at least one of the award groups associated with an indicated award when it is determined that the indicated award is not to be provided to the player.

* * * * *

UNITED STATES PATENT AND TRADEMARK OFFICE

CERTIFICATE OF CORRECTION

PATENT NO. : 7,771,266 B2
APPLICATION NO. : 10/660810
DATED : August 10, 2010
INVENTOR(S) : Gerrard et al.

It is certified that error appears in the above-identified patent and that said Letters Patent is hereby corrected as shown below:

In Claim 41, Column 24, Line 21, replace "instruction" with --instructions--.

In Claim 42, Column 24, Line 26, replace "instruction" with --instructions--.

In Claim 43, Column 24, Line 56, replace "," with --;--.

In Claim 43, Column 24, Line 59, after "groups;" insert --and--.

Signed and Sealed this

Sixteenth Day of November, 2010

David J. Kappos

David J. Kappos
*Director of the United States Patent and Trademark Office*